US010488109B2

(12) United States Patent
Nozawa et al.

(10) Patent No.: US 10,488,109 B2
(45) Date of Patent: Nov. 26, 2019

(54) METHOD AND APPARATUS FOR DEHYDRATING VENEER

(71) Applicant: Meinan Machinery Works, Inc., Obu-shi (JP)

(72) Inventors: Yoshioki Nozawa, Aichi (JP); Shin-ichi Sakamoto, Aichi (JP)

(73) Assignee: Meinan Machinery Works, Inc., Obu-shi (JP)

( * ) Notice: Subject to any disclaimer, the term of this patent is extended or adjusted under 35 U.S.C. 154(b) by 1332 days.

(21) Appl. No.: 14/080,893

(22) Filed: Nov. 15, 2013

(65) Prior Publication Data

US 2015/0135975 A1 May 21, 2015

(51) Int. Cl.

| | |
|---|---|
| ***B30B 3/04*** | (2006.01) |
| ***F26B 13/28*** | (2006.01) |
| ***F26B 5/14*** | (2006.01) |

(52) U.S. Cl.

CPC ..... *F26B 13/28* (2013.01); *B30B 3/04* (2013.01); *F26B 5/14* (2013.01); *F26B 2210/14* (2013.01)

(58) Field of Classification Search

CPC ..... F26B 13/28; F26B 5/14; F26B 2210/14; B30B 3/04; B27D 1/005

USPC ..... 100/37, 168, 169, 170, 171

See application file for complete search history.

(56) References Cited

U.S. PATENT DOCUMENTS 144,771 A * 11/1873 Kilgore ..... B27C 1/04 144/117.1
539,740 A * 5/1895 Ingman ..... B26D 7/018 83/422
838,772 A * 12/1906 Crane ..... B27C 1/04 144/250.13
1,542,097 A * 6/1925 Ripley ..... B26D 7/2635 144/250.13
2,265,749 A * 12/1941 Stevens ..... B29D 23/24 100/169
2,800,935 A * 7/1957 Hosmer ..... B27L 1/10 144/208.1
3,429,166 A * 2/1969 Baker ..... B21B 13/147 72/242.2
3,498,215 A * 3/1970 Brinkman ..... B27D 3/00 100/155 R (Continued)

OTHER PUBLICATIONS

Google Definition—capsule; retrieved on Jun. 11, 2018.*

*Primary Examiner* — Jimmy T Nguyen
(74) *Attorney, Agent, or Firm* — Locke Lord LLP

(57) ABSTRACT

Method and apparatus for dehydration of veneer sheet having therein a knot are disclosed. Veneer dehydration apparatus includes a first stationary single dehydrating roller and a plurality of second movable sectional dehydrating rollers, which rollers are disposed one above the other so that a nip through which a veneer sheet for dehydration is moved is formed between the first and second rollers. A stop device determines the initial position of each second roller relative to the first roller where a predetermined spaced distance is formed between the first and the second rollers. An urging device yieldably urges each second roller to the initial position. The second roller is movable away from the initial position against the urging force of the urging device independently of the other second rollers by a knot present in the veneer sheet and just moving through the nip between the second roller and the first roller.

14 Claims, 18 Drawing Sheets

(56) References Cited

U.S. PATENT DOCUMENTS

| | | | | | |
|---|---|---|---|---|---|
| 4,487,050 | A * | 12/1984 | Kajiwara | B21B 13/14 | 72/241.8 |
| 4,558,725 | A * | 12/1985 | Veneziale | B27D 1/005 | 100/121 |
| 4,765,380 | A * | 8/1988 | Watanabe | B27L 5/025 | 144/213 |
| 4,788,911 | A * | 12/1988 | Bishop | B32B 17/10862 | 100/155 G |
| 5,471,921 | A * | 12/1995 | Kubat | B30B 9/20 | 100/106 |
| 6,505,658 | B2 | 1/2003 | Koba | | |
| 2007/0044922 | A1* | 3/2007 | Mischler | B29C 70/382 | 156/574 |
| 2008/0134739 | A1* | 6/2008 | Hayashi | B21B 37/68 | 72/9.1 |

* cited by examiner

METHOD AND APPARATUS FOR DEHYDRATING VENEER

BACKGROUND OF THE INVENTION

The present invention relates to an apparatus for dehydrating wood veneer or removing water contained in veneer by mechanical squeezing and also to a method therefor.

Wood veneer has been used widely for production of various veneer laminated products such as plywood, laminated veneer lumber (LVL), etc. Multiple layers of veneer are assembled together with an adhesive into the form of a panel, a board or lumber. Prior to the assembling, sheets of green or undried veneer are dried to the desired level of moisture content. As a preparation for such drying, dehydration of veneer or removing part of the water contained in the veneer by mechanical compression or squeezing of the veneer across the thickness thereof has been practiced in some veneer or plywood mills.

A typical veneer dehydrating apparatus is disclosed by U.S. Pat. No. 6,505,658. The veneer dehydrating apparatus has a pair of rotatable dehydrating rollers disposed one above the other with the axes thereof extending parallel to each other and at least one of the rollers is positively driven. The paired upper and lower dehydrating rollers are spaced radially so that a nip is formed between the peripheries thereof. The nip or the smallest spaced distance between the peripheral surfaces of the paired upper and lower rollers is smaller than the thickness of the veneer sheet to be dehydrated so that the veneer is squeezed by the rollers and part of the water contained in the veneer is removed.

In some veneer dehydrating apparatuses, the dehydrating rollers disposed one above the other are spaced at a spaced distance between the peripheral surfaces thereof that accounts for about 50% of the thickness of veneer sheet for dehydration. In dehydrating veneer by compression or squeezing, however, the presence of a relatively hard knot in wood veneer poses a problem.

Generally, the elastic range in the grain direction of a veneer sheet subjected to compression is much smaller than the elastic ranges in the tangential direction, i.e. the direction across the grain direction, and in the radial direction, i.e. the thickness direction. A knot in a veneer sheet, which is originally the base of a side branch of a tree, has its grain oriented across the grain of the veneer sheet. Specifically, the grain of a knot in a veneer sheet is oriented in the thickness direction of the veneer sheet. Therefore, when a veneer sheet having therein any knot is passed between the dehydrating rollers and compressed across the thickness by such rollers, the strain of the knot easily exceeds its elastic-plastic range, with the result that the knot is broken into small pieces and a void is formed through the veneer sheet where the knot was present. A veneer having such a void or open hole is graded as low quality veneer and the veneer laminated product having therein such veneer is regarded as low quality product, accordingly. Though the spaced distance between the dehydrating rollers may be enlarged with an attempt to protect the knot against breakage, the reduced compression due to the increased spaced distance may nullify the dehydrating effect of the apparatus.

Therefore, the present invention which has been made in light of the above problem, is directed to proving a veneer dehydrating method and apparatus that offer effective dehydration for veneer having therein a knot.

SUMMARY OF THE INVENTION

Veneer dehydrating apparatus according to the present invention is configured to compress a veneer sheet thereby to squeeze or remove part of the water contained in the veneer sheet by using two sets of dehydrating rollers disposed one above the other. The two sets of dehydrating rollers includes a stationary first dehydrating roller which is driven positively to rotate about an axis of rotation thereof and a plurality of rotatable second dehydrating rollers having respective axes of rotation extending parallel to the axis of rotation of the first dehydrating roller. The second dehydrating rollers are individually movable toward and away from the first dehydrating roller. The apparatus further includes a stop device which determines the initial setting position of each second dehydrating roller relative to the first stationary dehydrating roller where the second dehydrating roller is spaced from the first dehydrating roller at a predetermined distance that is smaller than the thickness of the veneer sheet for dehydration, e.g. about 30% of the original thickness of the veneer sheet. Each second dehydrating roller is yieldably urged by an urging device such as hydraulic cylinder to the above initial setting position with a force that is the largest in the range of force in which very little breakage or collapse occurs in a knot present in the veneer sheet and passing between the first and the second dehydrating rollers. Each second dehydrating roller is yieldable or movable away from the initial setting position independently of the other second dehydrating rollers when a knot that is relatively hard in the veneer sheet just moves between the first and the second dehydrating rollers.

The veneer dehydrating apparatus further includes a support device rotatably supporting each second dehydrating roller and swingable about a pivot. The urging device urges the second dehydrating roller by way of the support device and the stop device determines the initial setting position of each second dehydrating roller relative to the first stationary dehydrating roller, for example, by limiting the swinging motion of the support device.

The second dehydrating rollers of a veneer dehydrating apparatus are disposed with the space formed between any two adjacent second dehydrating rollers. The veneer dehydrating apparatus may further include a filler member which is fixedly mounted to the support device for each second dehydrating roller at a position between any two adjacent second dehydrating rollers and spaced away from the first dehydrating roller at a distance that is substantially the same as or smaller than the thickness of the veneer sheet. The filler member is configured to fill partially the space between any two adjacent second dehydrating rollers thereby to restrict the flow of water squeezed out from the veneer sheet.

Method for dehydrating veneer according to the present invention includes preparing a veneer sheet with a predetermined thickness and having therein a relatively hard knot and of providing the aforementioned stationary first dehydrating roller and a plurality of rotatable second dehydrating rollers. The method further includes yieldably urging each second dehydrating roller toward the first dehydrating roller to the initial setting position where the second dehydrating roller is spaced from the first dehydrating roller at a predetermined distance that is smaller than thickness of the veneer sheet with an urging that is largest in the range of force that causes very little breakage to a knot present in the veneer sheet, and passing the veneer sheet between the first dehydrating roller and the second dehydrating rollers.

Features and advantages of the present invention will become more apparent to those skilled in the art from the following description of various embodiments of the present invention, which description is made with reference to the accompanying drawings, wherein:

DETAILED DESCRIPTION OF THE EMBODIMENTS

The following will describe the veneer dehydrating apparatus of the first preferred embodiment of the present invention with reference to FIGS. 1 through 11.

Figure 1:
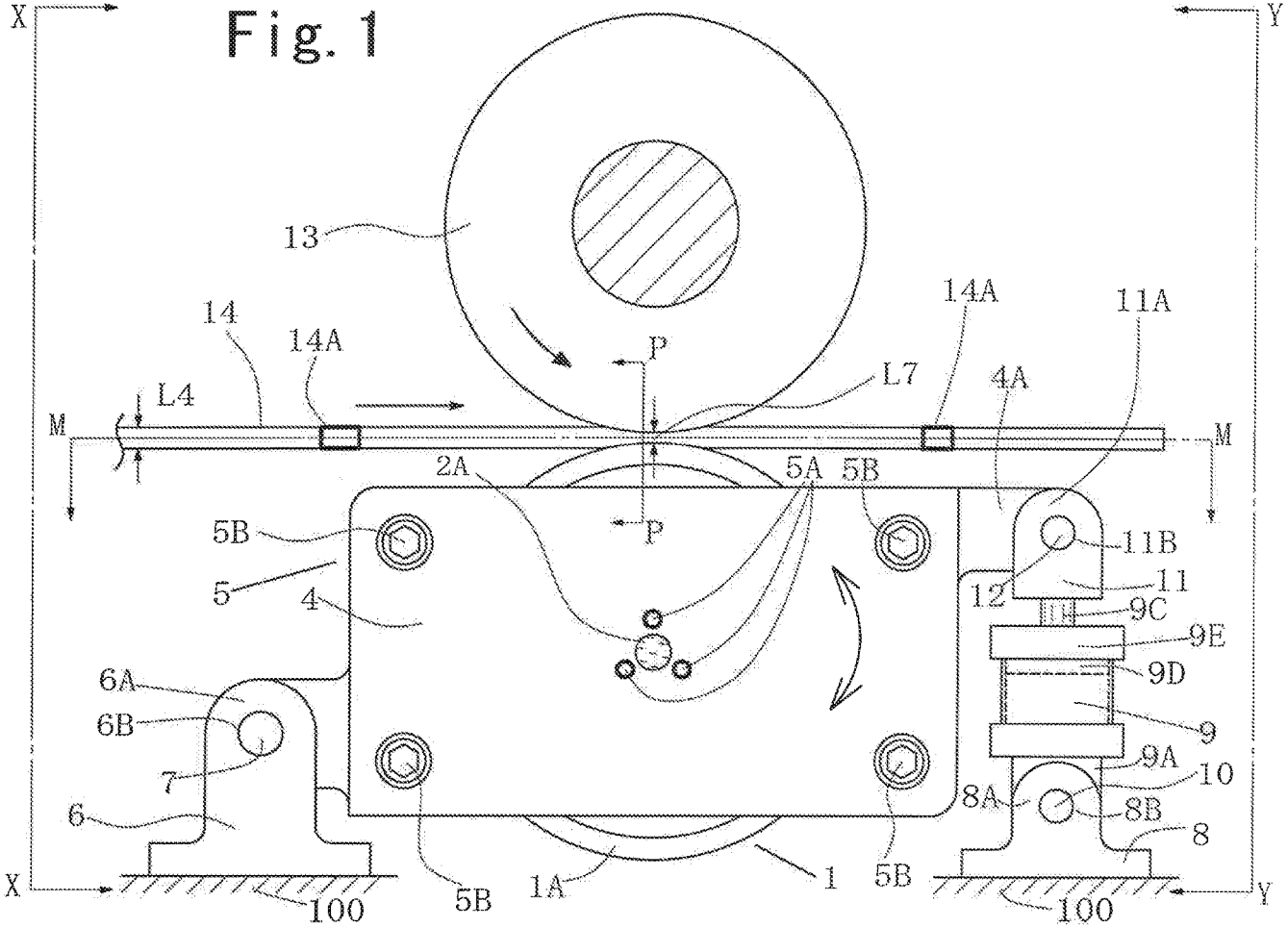
FIG. 1 is a schematic side view of a veneer dehydrating apparatus according to a first preferred embodiment of the present invention.

Referring firstly to FIG. 1, reference numeral 14 designates a sheet of green or undried veneer having a thickness L4 and being moved in the arrow direction. The veneer sheet 14 has therein a knot 14A that is relatively hard. The veneer dehydrating apparatus includes a single upper stationary dehydrating roller 13 extending in the width direction of the veneer dehydrating apparatus that is perpendicular to the direction in which the veneer sheet 14 is moved. The upper dehydrating roller 13 is positively driven by an electric motor (not shown) to rotate in the arrow direction. The veneer dehydrating apparatus further includes a plurality of lower rotatable dehydrating rollers 1 (only one roller 1 being shown in FIG. 1) which are disposed just below the upper dehydrating roller 13 with the axes of rotation thereof extending parallel to the axis of rotation of the upper dehydrating roller 13. The lower dehydrating rollers 1 are individually movable relative to the upper dehydrating roller 13 and arranged axially over a distance that substantially corresponds to the axial length of the single stationary upper dehydrating roller 13. The lower dehydrating rollers 1 are spaced from the upper dehydrating roller 13 so that a space or a nip is formed between the peripheries of the upper roller 13 and the lower rollers 1, through which the veneer sheet 14 is passed while being compressed or squeezed in the thickness direction for dehydration of the veneer sheet 14. Each lower dehydrating roller 1 is rotatably supported by a support device including a pair of first and the second support members 3, 4 which are swingable about a pivot shaft 7 and urged upward by their associated hydraulic cylinders 9, so that the lower dehydrating roller 1 is movable toward and away from the first roller 13 individually by the swinging motion of the support members 3, 4, as will be described in greater detail in later part hereof.

Figure 2:
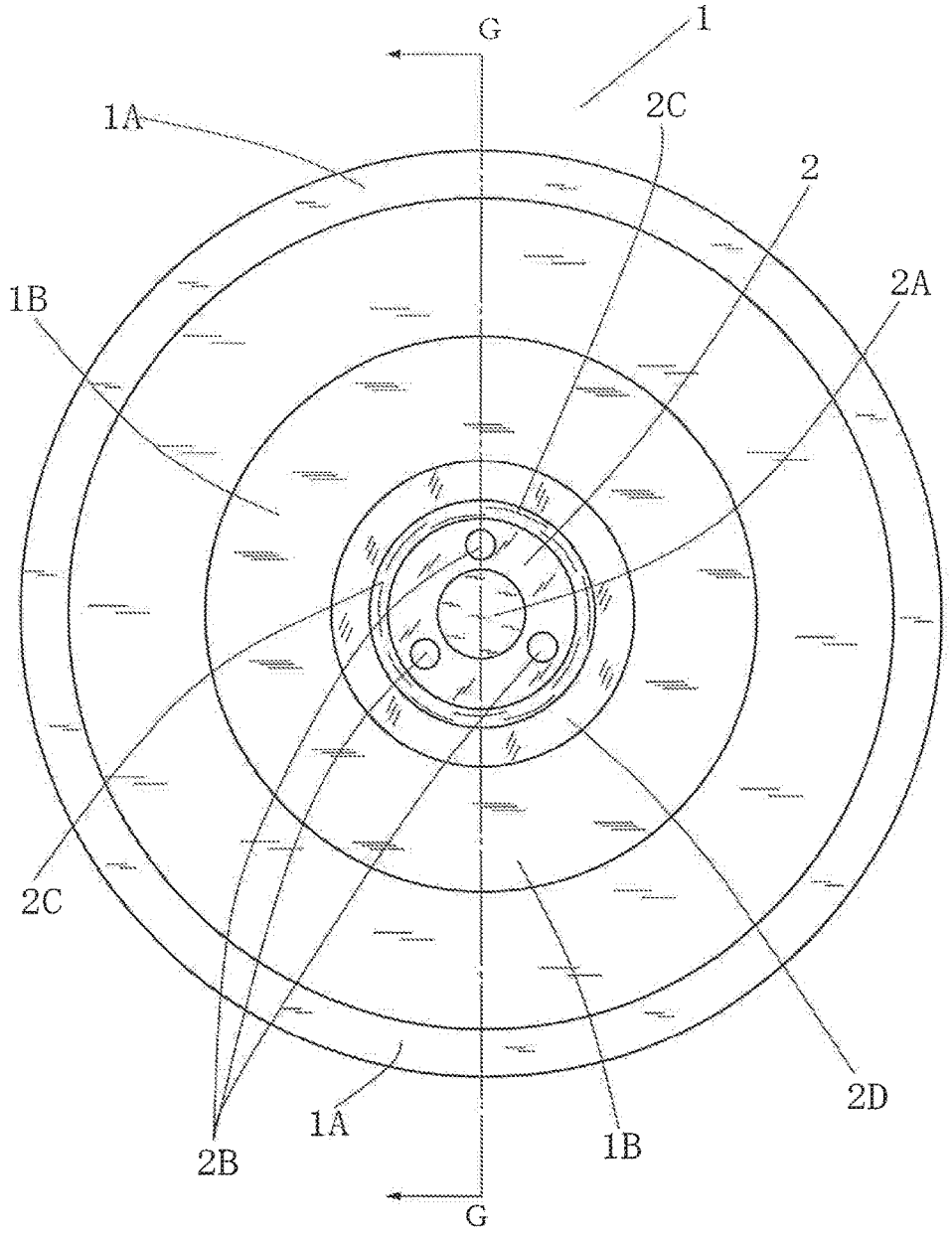
FIG. 2 is a side view of a lower dehydrating roller of the apparatus of FIG. 1 shown with its support member removed for clarity.
Figure 3:
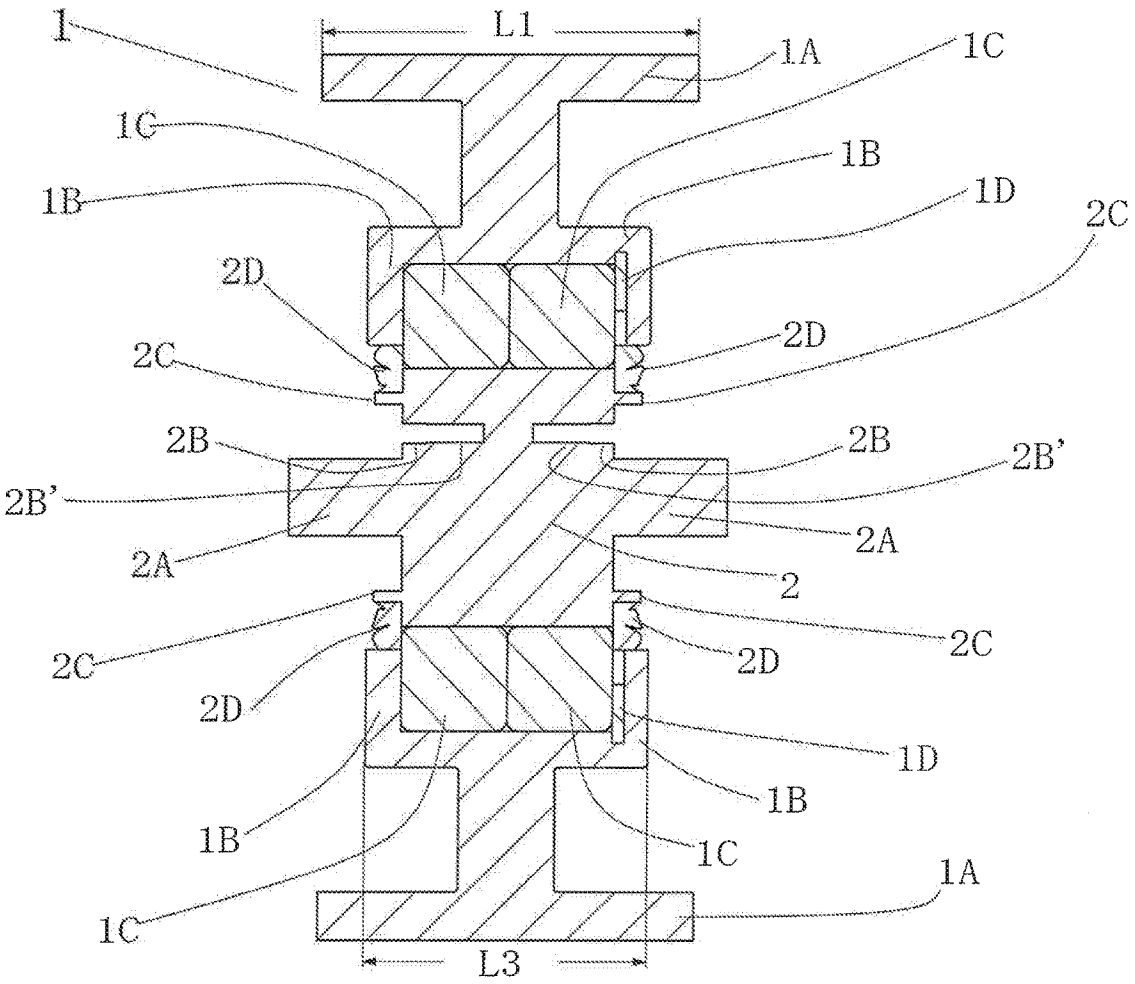
FIG. 3 is a sectional view of the lower dehydrating roller and a support shaft taken along line G-G in FIG. 2 and viewed in the arrow direction.
Figure 4:
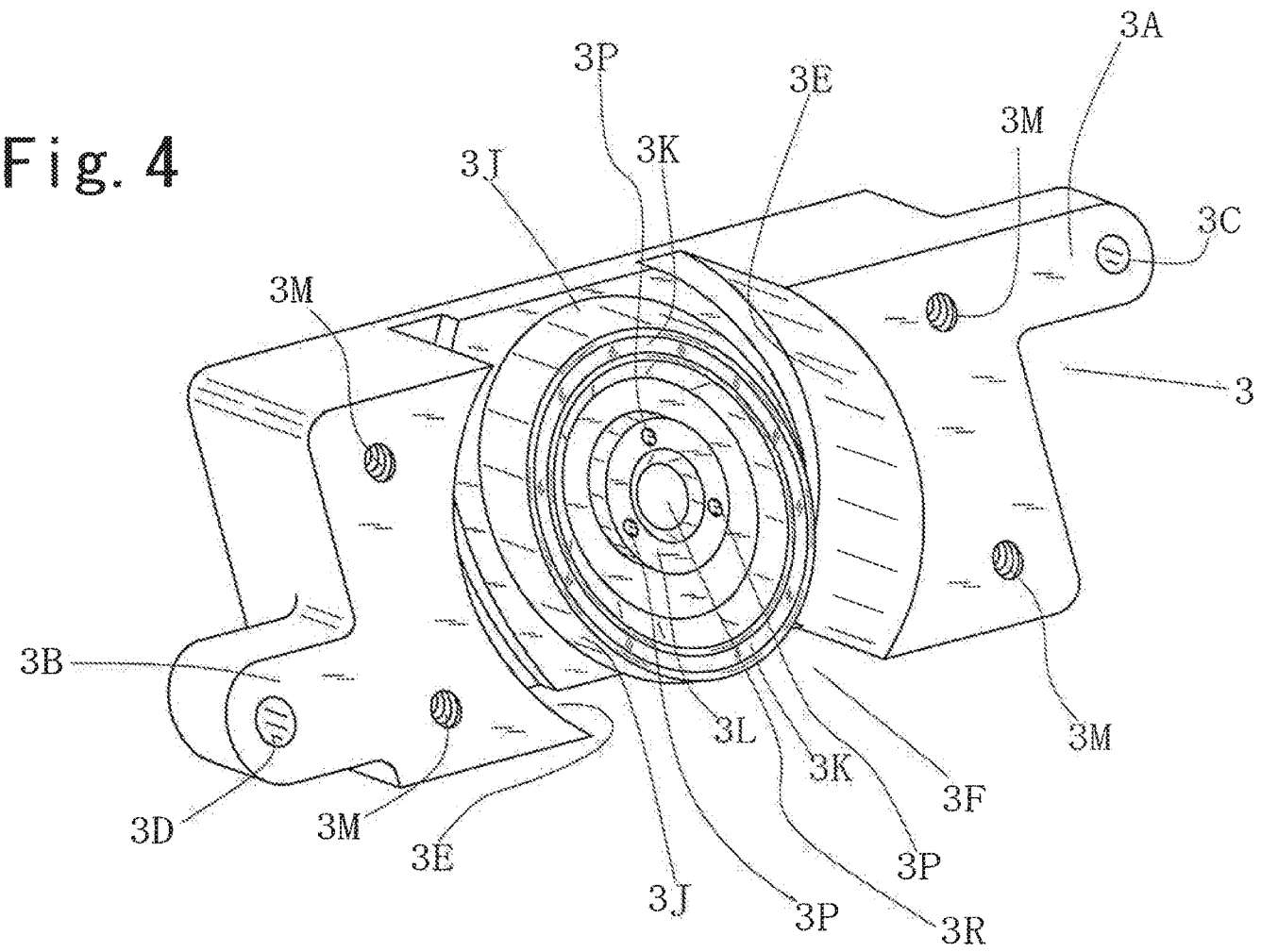
FIG. 4 is a perspective view of a first support member for the lower dehydrating roller of FIGS. 2 and 3.
Figure 5:
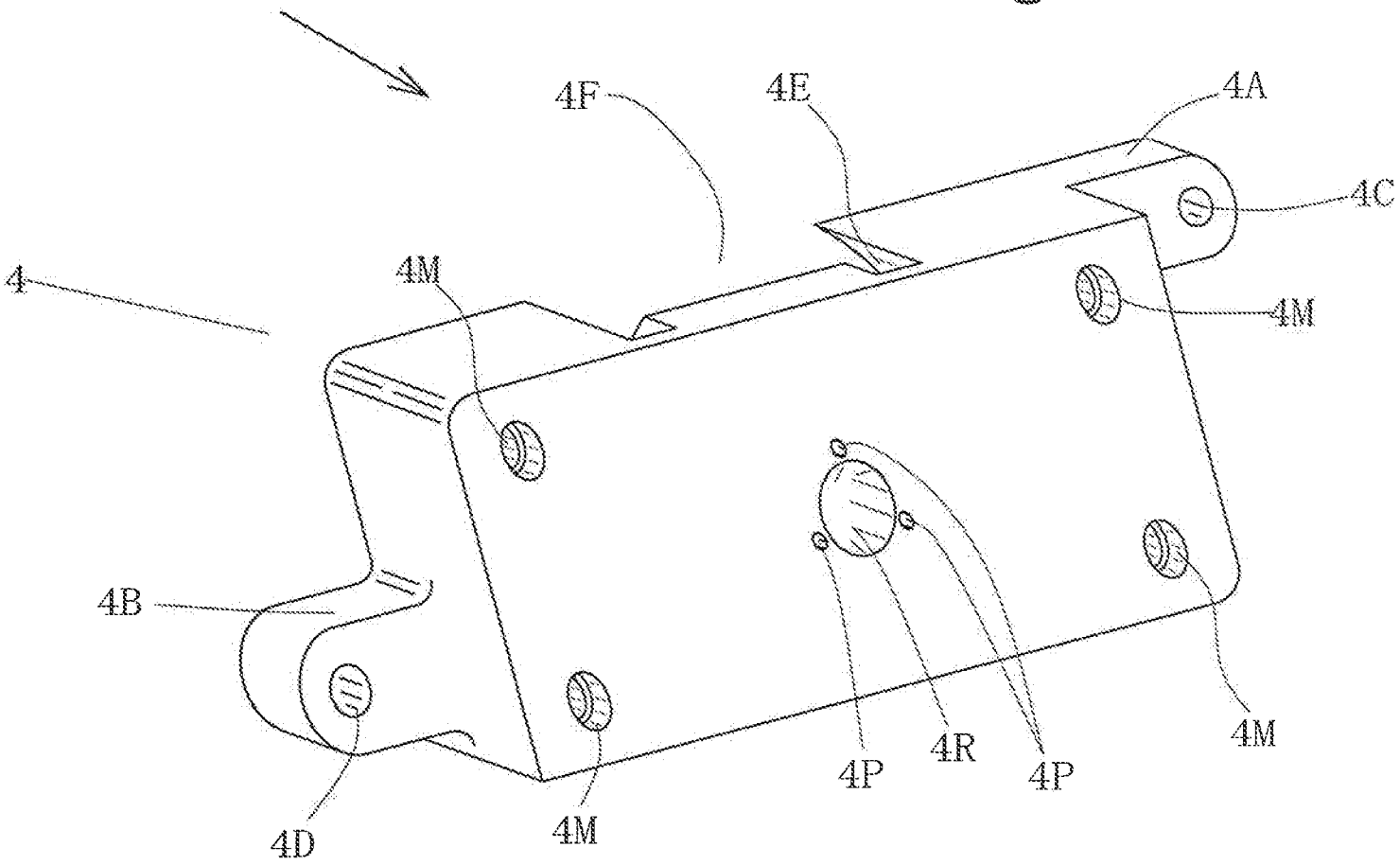
FIG. 5 is a perspective view of a second support member for the lower dehydrating roller of FIGS. 2 and 3.
Figure 6:
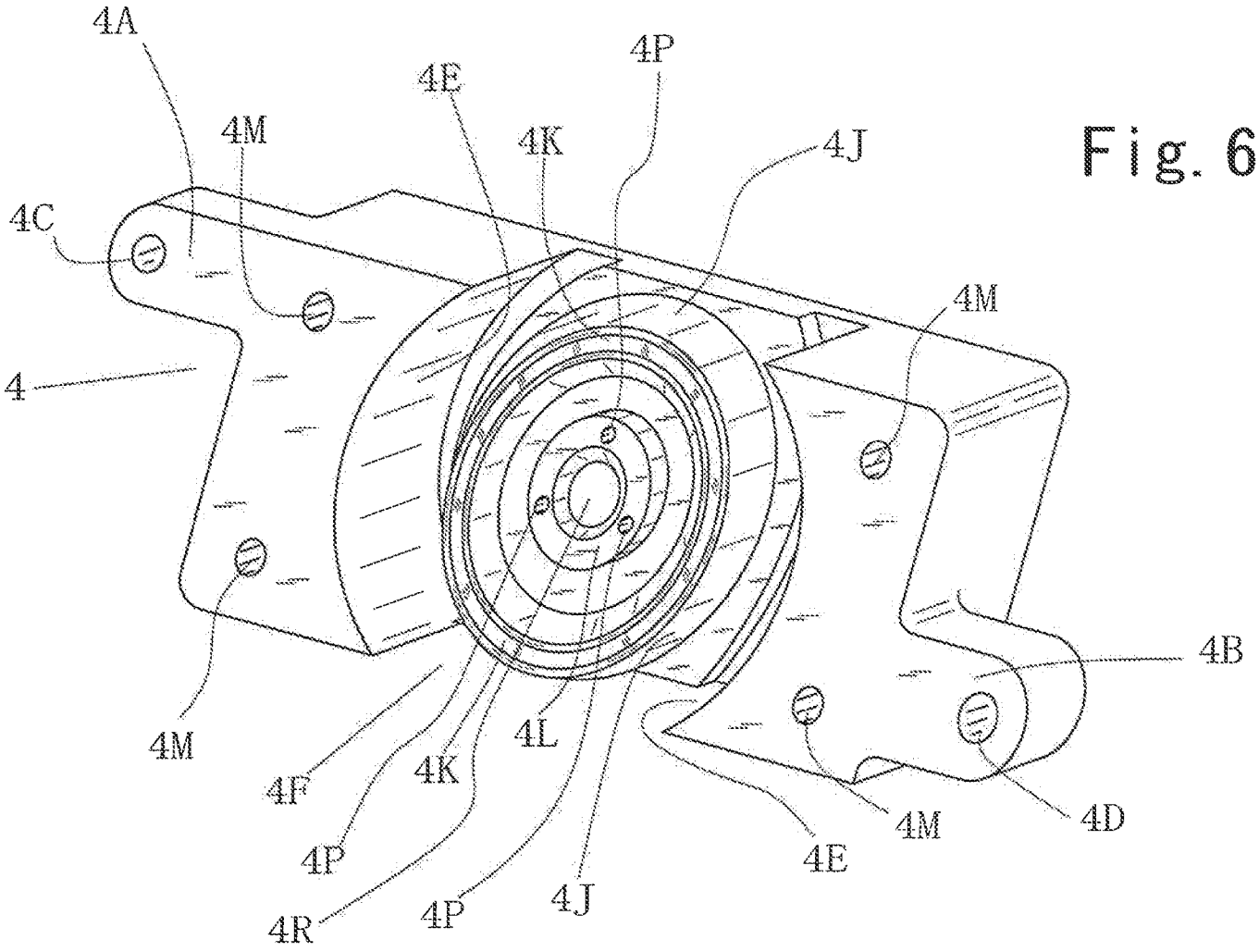
FIG. 6 is a perspective view of the second support member as seen in the arrow direction of FIG. 5.

The following will describe the lower dehydrating roller 1 and its associated support mechanism in detail. Referring to FIGS. 2 and 3, each lower dehydrating roller 1 has a peripheral annular rim portion 1A with a width L1 and a boss portion 1B with a width L3 that is smaller than L1. The lower dehydrating roller 1 is rotatably mounted at the boss portion 21B on a support shaft 2 through bearings 1C held in place in the boss portion 1B by a snap ring 1D. The lower dehydrating roller 1 is supported and held by and between the first support member 3 and the second support member 4 (only the second support member 4 being shown in FIG. 1). Specifically, the support shaft 2 on which the lower roller 1 is rotatably supported has at the opposite ends thereof cylindrical projections 2A and the first and the second support members 3, 4 have formed therethrough at the center thereof holes 3R, 4R and three holes 3P, 4P located around the respective center holes 3R, 4R (FIGS. 4, 5 and 6). Additionally, the support shaft 2 has on the opposite ends thereof at positions radially outward of the respective cylindrical projections 2A annular projections 2C and an annular oil seal 2D is inserted in the space between the cylindrical projection 2A and its corresponding annular projection 2C to prevent the ingress of water produced by veneer squeezing into the bearings 1C. The lower dehydrating roller 1 is supported by the first and the second support members 3, 4 with the cylindrical projections 2A of the support shaft 2 inserted through the center holes 3R, 4R of the support members 3, 4 and the first and the second support members 3, 4 are fixed to the support shaft 2 by means of socket shoulder bolts 5A inserted through the holes 3P, 4P of the support members 3, 4 and screwed into their corresponding threaded holes 2B' which are formed in the support shaft 2. The state in which the first and the second support members 3, 4 are combined together to hold therebetween the lower roller 1 is shown most clearly in FIG. 7.

Figure 7:
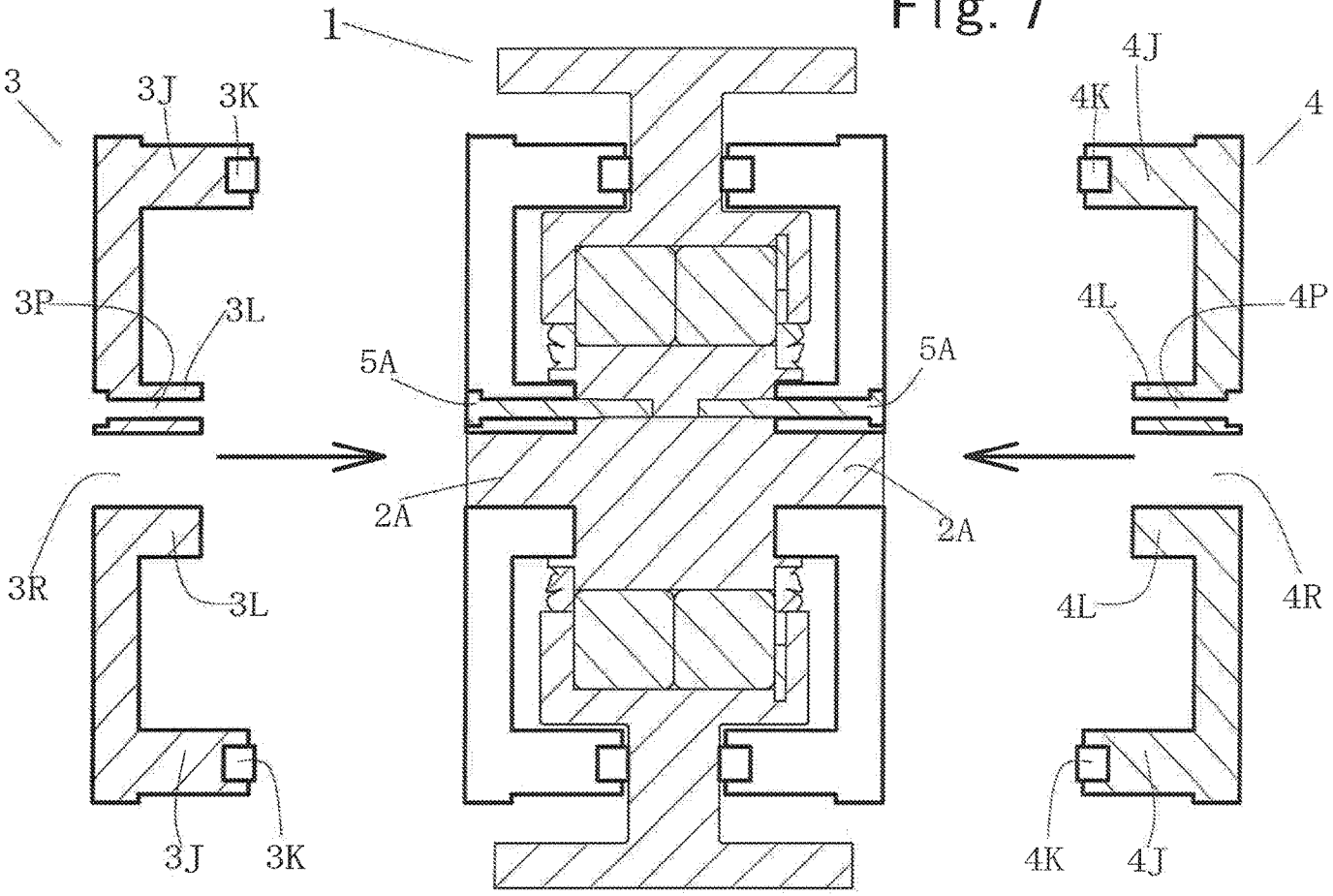
FIG. 7 is an illustrative view showing the positional relation between the lower dehydrating roller and the first and the second support members.

The first and the second support members 3, 4 will be described in detail with reference to FIGS. 4, 5 and 6. The first support member 3 has at diagonal positions thereof mounting lugs 3A, 3B having formed therethrough holes 3C, 3D, respectively. The second support members 4 also has at diagonal positions thereof mounting lugs 4A, 4B having formed therethrough holes 4C, 4D, respectively. Though the first and the second support members 3, 4 are substantially of the same structure, the two support members 3, 4 are formed symmetrically with respect to the lower roller 1 held between the support members 3, 4. To be more specific, the first and the second support members 3, 4 are formed in such a manner that the mounting lugs 3A, 3B of the first support member 3 and the mounting lugs 4A, 4B of the second support member 4 are formed at such diagonal positions that the holes 3C, 3D are in alignment with the respective holes 4C, 4D when the support members 3, 4 are combined together thereby to hold therebetween the lower dehydrating roller 1 as shown in FIG. 7.

Referring to FIG. 4 showing the first support member 3 in perspective view, a space 3F is formed in the first support member 3 between the outer circumferential surface of an outer annular projection 3J and two separate inner peripheral curved surfaces 3E formed in the shape of an arc of a circle with a diameter that is greater than that of the second dehydrating roller 1 and located on horizontally opposite sides of the center hole 3R. An annular groove (not shown) is formed in the end of the outer annular projection 3J and an annular seal member 3K made of a urethane rubber is inserted in the annular groove. The seal member 3K has such a thickness that a part of the seal member 3K extends out from the end of the outer annular projection 3J by about 2 to 3 mm. An inner annular projection 3L is formed inward of the outer annular projection 3J and the aforementioned three bolt holes 3P are formed through this inner annular projection 3L of the first support member 3 at positions that correspond to the threaded holes 2B in the support shaft 2 for receiving therein the bolts 5A fastening the first support member 3 to the support shaft 2. The aforementioned center hole 3R is formed in the first support member 3 at a position inward of the inner annular projection 3L. Additionally, the first support member 3 has formed therein at positions adjacent to the four corners thereof threaded holes 3M.

As mentioned earlier, the first and the second support members 3, 4 are of substantially the same structure and the parts or the structures of the second support member 4 that correspond to the counterparts of the first support member 3 are depicted by the same reference character with the affix "4" in FIGS. 5 and 6, so that detailed description of the second support member 4 will be omitted. As indicated earlier, however, the first and the second support members 3, 4 differ from each other in that the two support members 3, 4 are configured in a symmetrical manner with respect to the lower roller 1 when these components are assembled together as shown in FIG. 7. Additionally, as will be appreciated from comparison of FIG. 4 and FIGS. 5, 6, the second support member 4 differs from the first support member 3 in that the holes 4M formed at positions adjacent to the four corners of the second support member 4 are plain holes having no thread. The threaded holes 3M and the plain holes 4M are formed at such four positions that permits the threaded holes 3M to be aligned with the plain holes 4M for receiving therein socket shoulder bolts 5B when the first and the second support members 3, 4 are combined together.

In assembling the first and the second support members 3, 4 to the lower dehydrating roller 1, firstly the support members 3, 4 are mounted on the opposite cylindrical projections 2A of the support shaft 2 with the projections 2A inserted through the center holes 3R, 4R of the support members 3, 4, respectively, and also with the holes 3C, 3D of the first support member 3 and the holes 4C, 4D of the second support member 4 set in alignment with each other, respectively. By so mounting the first and the second support members 3, 4, the threaded holes 3M and the plain holes 3P of the first support member 3 are set in alignment with their corresponding plain holes 4M and the holes 4P of the second support member 4. Assembling of the support members 3, 4 to the lower dehydrating roller 1 may be completed by tightening the bolts 5A in the holes 3P and 4P and the bolts 5B in the holes 3M and 4M, respectively. In the present embodiment, the first and the second support members 3, 4, the support shaft 2 and their associated parts cooperate to form a roller support device 5 that rotatably supports the lower dehydrating roller 1.

Referring back to FIGS. 1 and 8, reference numeral 6 designates a first support block fixed to the frame 100 of the veneer dehydrating apparatus and configured to support the roller support device 5 at the mounting lugs 3B, 4B of the first and the second support members 3, 4. The first support block 6 is of a U-shape (FIG. 8) having a pair of vertical portions 6A, and the mounting lugs 3B, 4B of the first and the second support members 3, 4 are received between these vertical portions 6A of the first support block 6 and fixedly mounted on the pivot shaft 7. The pivot shaft 7 is fixedly inserted in the holes 3D, 4D of the mounting lugs 3B, 4B and rotatably supported in holes 6B which are formed through the vertical portions 6A of the first support block 6. Thus, the first and the second support members 3, 4 are fixedly mounted at the mounting lugs 3B, 4B on the rotatable pivot shaft 7 for rotation therewith, so that the support members 3, 4 are swingable about the pivot shaft 7 as indicated by double-headed arrow in FIG. 1.

Figure 9:
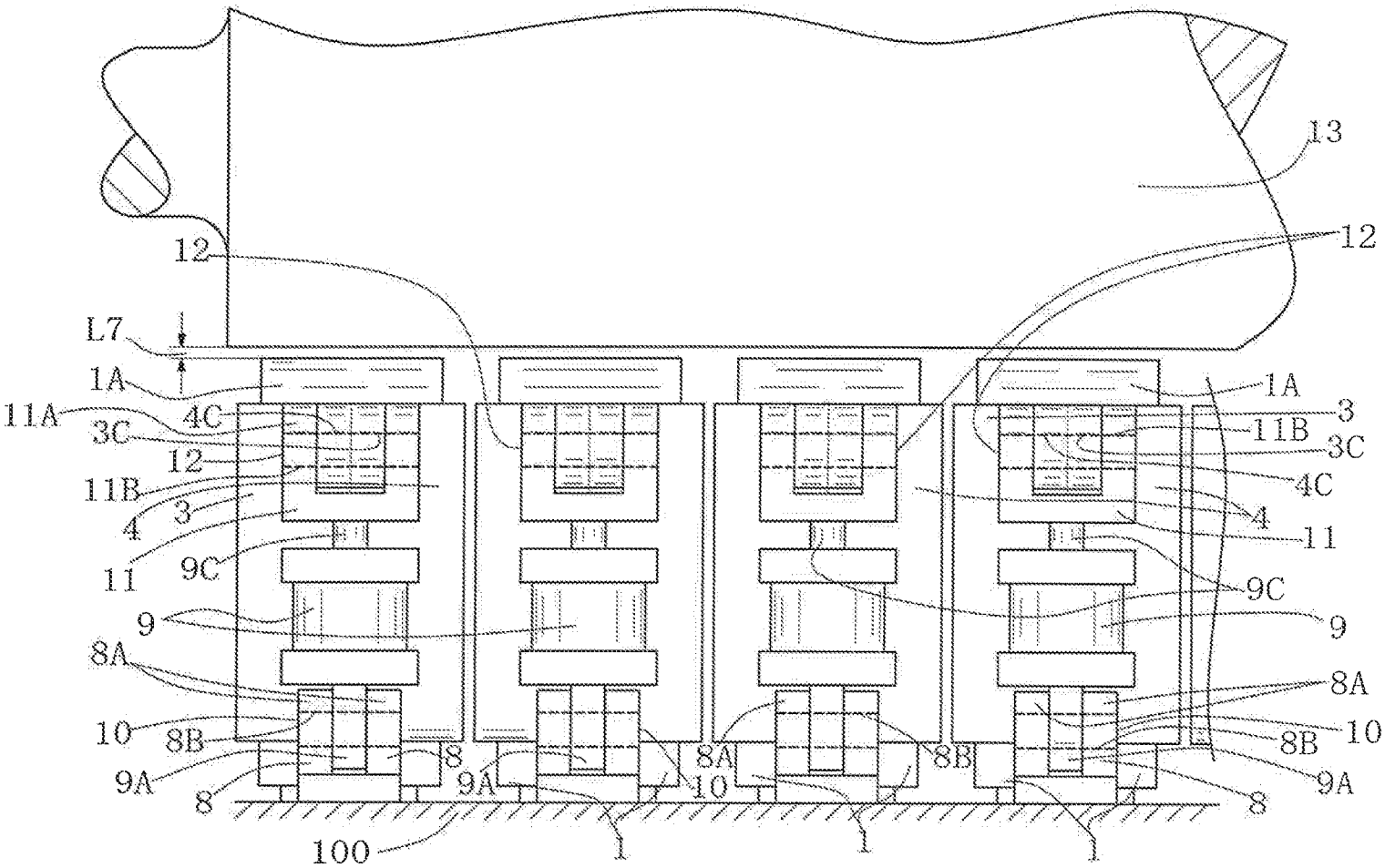
FIG. 9 is a fragmentary rear view of the veneer dehydrating apparatus as viewed in the arrow direction Y-Y of FIG. 1 with a veneer sheet removed for clarity.
Figure 10:
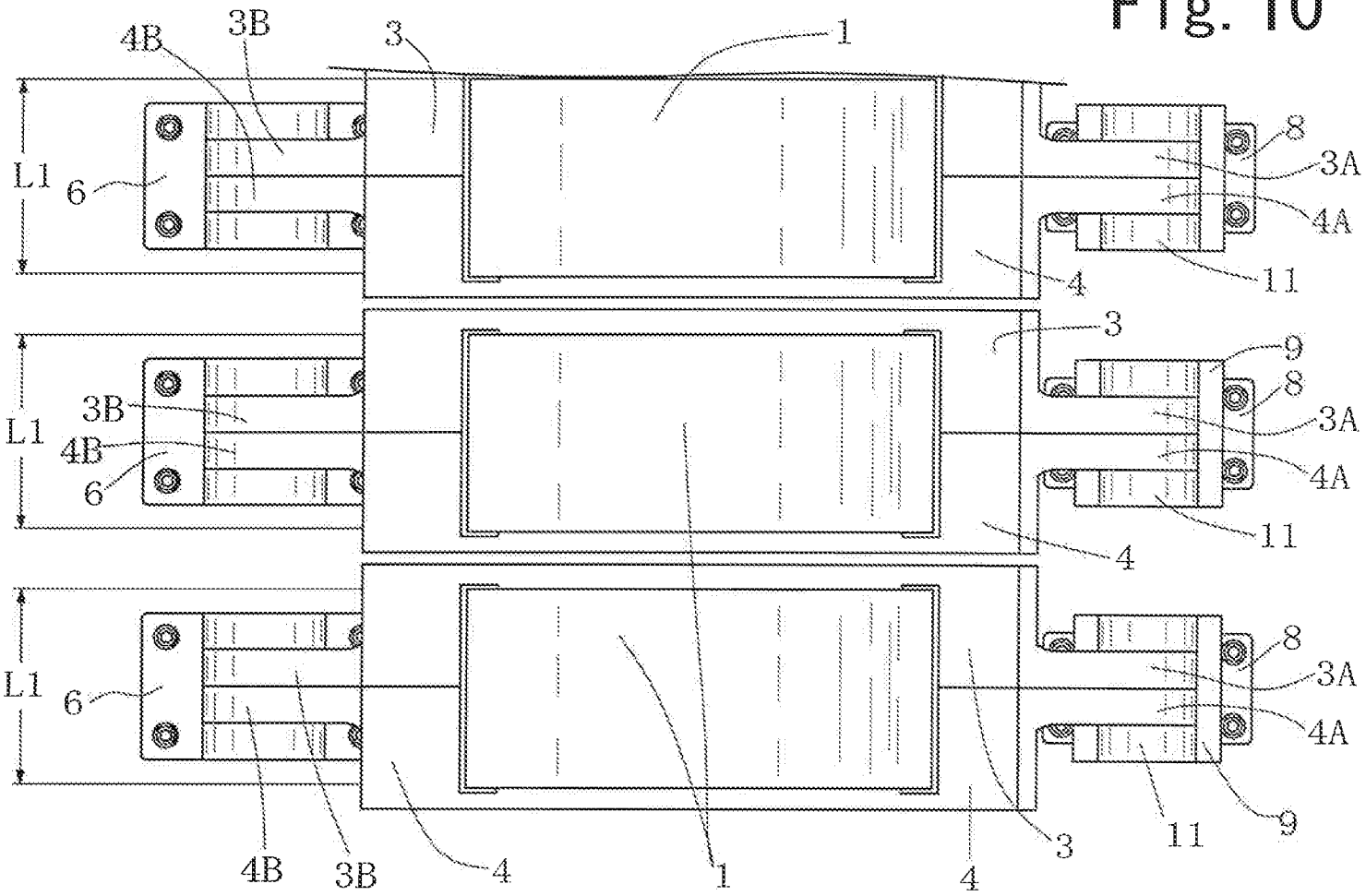
FIG. 10 is a fragmentary plan view of the veneer dehydrating apparatus as viewed in the arrow direction M-M of FIG. 1 with a veneer sheet removed for clarity.

Referring to FIGS. 1, 9 and 10, reference numeral 8 designates a second support block fixed to the frame 100 of the veneer dehydrating apparatus and numeral 9 the aforementioned hydraulic cylinder having a piston 9D indicated by dashed line in the cylinder 9 and a piston rod 9C connected to the piston 9D. The second support block 8 is also of a U-shape having a pair of vertical portion 8A and the cylinder 9 has a lower end 9A which is received between the vertical portions 8A. Specifically, the lower end 9A of the cylinder 9 is fixedly mounted on a shaft 10 which is rotatably supported in holes 8B which are formed through the vertical portions 8A of the second support block 8. Thus, the cylinder 9 is pivotally mounted at the lower end 9A thereof to the support block 8.

The piston rod 9C of the hydraulic cylinder 9 has at the upper end thereof a link member 11 which is also of a U-shape having a pair of vertical portions 11A, and the mounting lugs 3A, 4A of the first and the second support members 3, 4 are received between the vertical portions 11A of the link member 11 and fixedly mounted on a rotatable shaft 12. The shaft 12 is fixedly inserted in the holes 3C, 4C in the mounting lugs 3A, 4A and rotatably supported in holes 11B which are formed through the vertical portions 11A of the link member 11. Thus, the support members 3, 4 are pivotally mounted at the mounting lugs 3A, 4A thereof to the link member 11 of the cylinder 9. That is, the support members 3, 4 are pivotally connected via the link member 11 to the piston rod 9C of the hydraulic cylinder 9 for the swinging motion of the support members 3, 4 about the pivot shaft 7 in the double-headed arrow directions. In conjunction with such swinging motion of the support members 3, 4, the lower dehydrating roller 1 is moved toward and away from the upper dehydrating roller 13.

Figure 8:
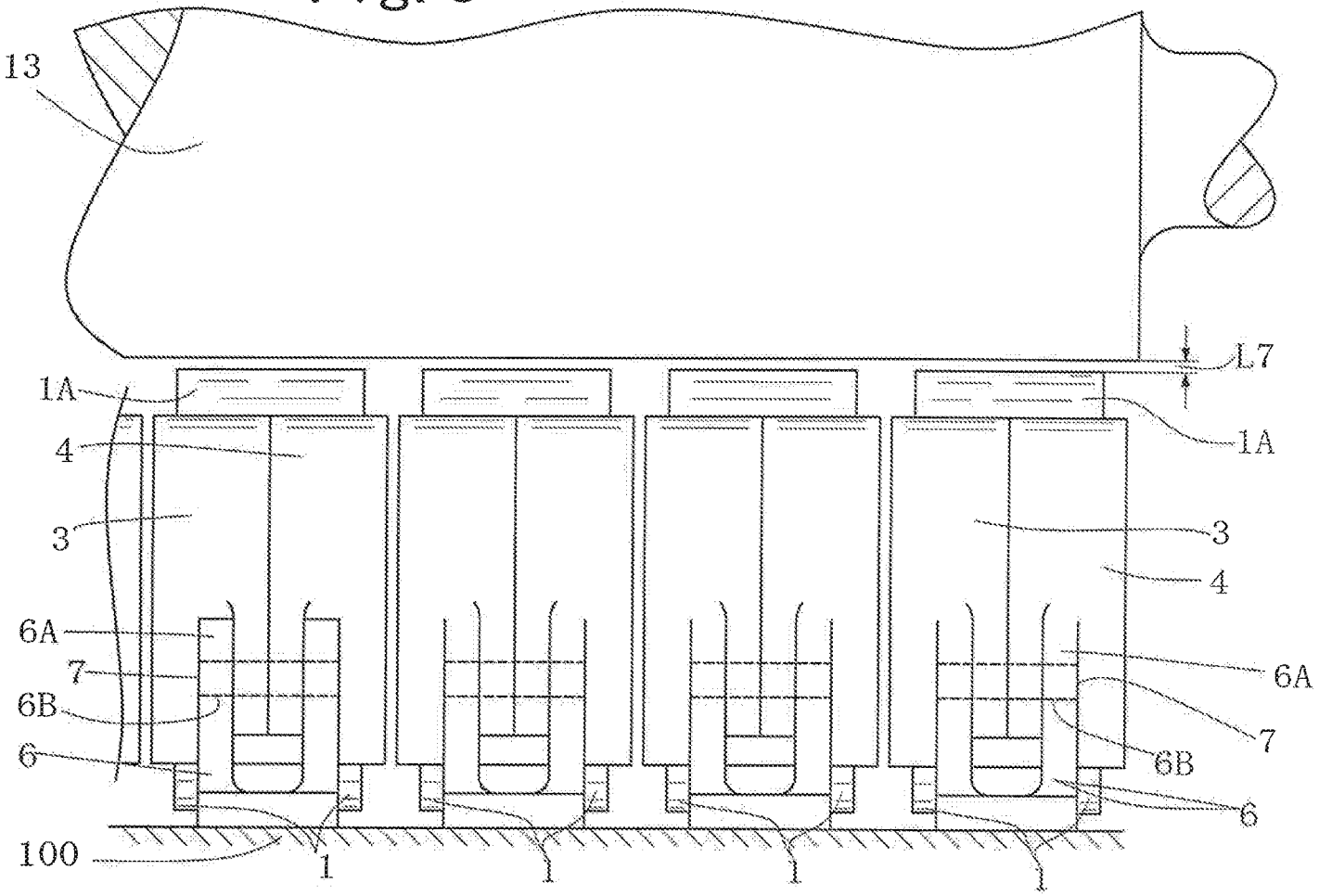
FIG. 8 is a fragmentary front view of the veneer dehydrating apparatus as viewed in the arrow direction X-X of FIG. 1 with a veneer sheet removed for clarity.

The lower dehydrating roller 1, the support device 5 including the first and the second support members 3, 4 and the support shaft 2, the hydraulic cylinder 9 and its associated parts, the pivot shafts 7 and 11 cooperate to constitute a lower dehydrating roller assembly, and a plurality of such dehydrating roller assemblies is disposed in side-by-side relation with the axes of the individual lower dehydrating rollers 1 extending parallel to the axis of the upper stationary dehydrating roller 13. As shown in FIGS. 8 and 9, the lower dehydrating roller assemblies are disposed with a spaced distance between any two adjacent assemblies to prevent any mechanical interference between the assemblies, thereby permitting the support members 3, 4 of each lower dehydrating roller assembly to swing independently of the support members of the other lower dehydrating roller assemblies. The total axial length of the lower dehydrating roller assemblies including the above spaced distances is substantially corresponds to the axial length of the stationary upper dehydrating roller 13.

The piston rod 9C of the hydraulic cylinder 9 is normally placed in its fully extended position shown in FIG. 1. This position of the piston rod 9C is determined by the contact of the movable piston 9D with the inner surface of the upper end 9E of the cylinder 9 that serves as a stop. In this position of the piston rod 9C, the lower dehydrating roller 1 carried by the support members 3, 4 is placed at a position where a spaced distance L7 is formed between the upper dehydrating roller 13 and the lower dehydrating roller 1, as shown in FIG. 1. In the present embodiment, the spaced distance L7 corresponds to about 30% of the thickness L4 of the veneer sheet 14 for dehydration. For this purpose, various parts and components of the apparatus such as the lower dehydrating roller 1, the first and the second support members 3, 4, the support blocks 6, 8 and the hydraulic cylinder 9 and its associated parts are so dimension and disposed that the formation of the spaced distance L7 is accomplished when the piston rod 9C is fully extended.

The cylinder 9 which serves as an urging device yieldably urges the lower dehydrating roller 1 to the position where the spaced distance L7 is provided between the upper and the lower dehydrating rollers 13, 1. The hydraulic pressure of the cylinder 9 is set so that the force that urges the lower dehydrating roller 1 toward the upper dehydrating roller 13 fulfills the following two condition. Namely, the urging force should be firstly such that a part of the veneer sheet 14 free of a knot such as 14A may be compressed approximately to a thickness corresponding to the spaced distance L7, i.e. about 30% of the original thickness of the veneer sheet 14 and secondly that very little breakage occurs in a knot such as 14A present in the veneer sheet 14 and passing between the upper and the lower dehydrating rollers 13, 1. In other words, the hydraulic cylinder 9 is configured to yieldably urge the lower dehydrating roller 1 toward the upper dehydrating roller 13 with a force that is the largest in the range of force that causes very little breakage to the knot 14A. It is noted that the actual force acting to urge the lower dehydrating roller 1 upward is approximately the difference between the hydraulic pressure exerted by the hydraulic cylinder 9 and the force acting downward due to the weight of the components such as the support members 3, 4 and the lower dehydrating roller 1. Therefore, the actual hydraulic pressure of the hydraulic cylinder 9 should be established with such difference taken into consideration.

The following will describe the operation of the veneer dehydrating apparatus according to the above-described first preferred embodiment of the present invention.

Figure 11:
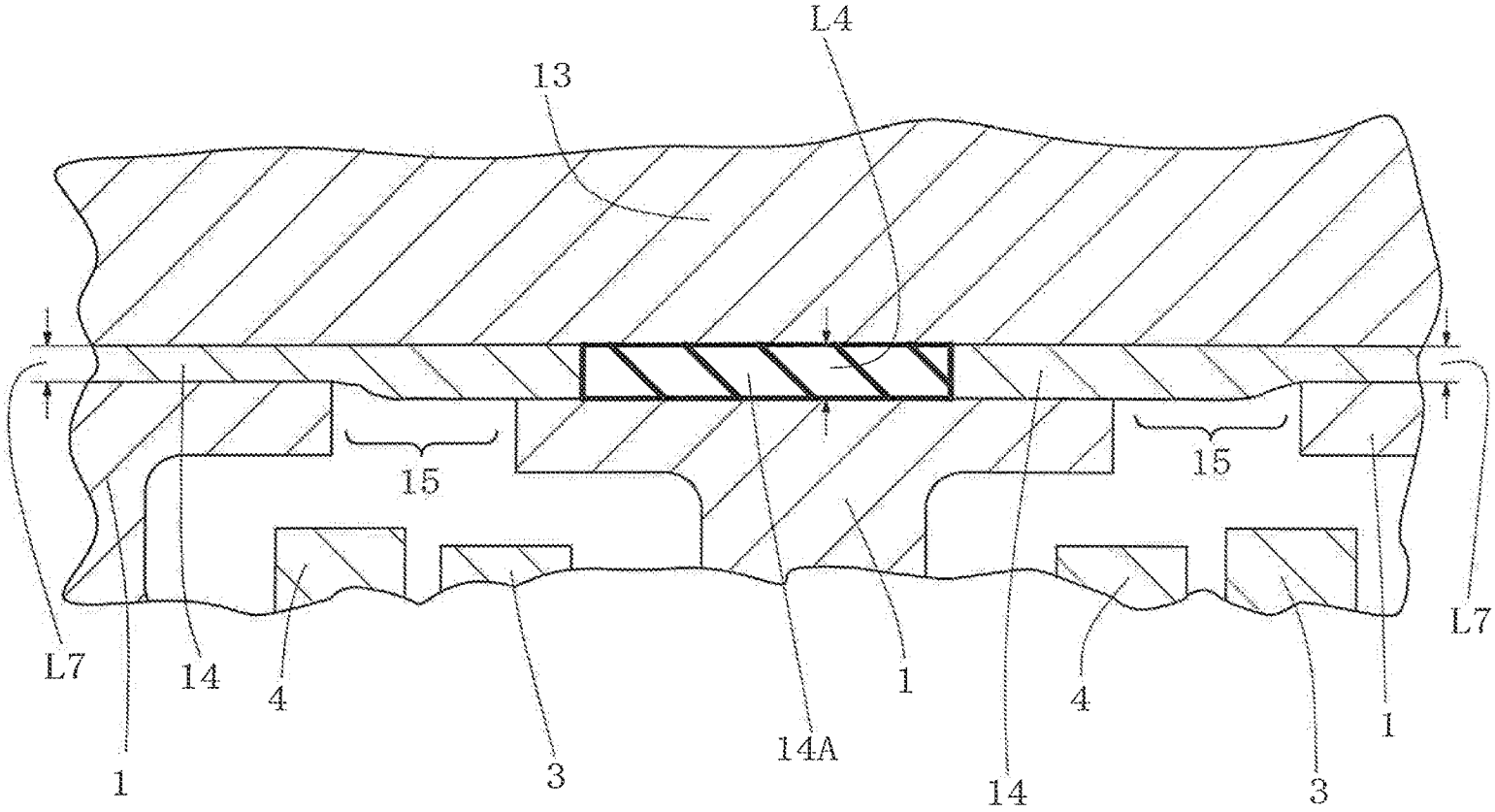
FIG. 11 is a partially-enlarged view of the veneer dehydrating apparatus as viewed in the arrow direction P-P of FIG. 1, the line P-P being shown shifted off the center to show arrows indicating the spaced distance L7.

In the initial setting of the apparatus, each lower dehydrating roller 1 is yieldably urged to the position where the spaced distance L7 is formed between the upper and the lower dehydrating rollers 13, 1. As indicated above, this position is determined by the contact of the piston 9D with the inner surface of the upper end 9E of the cylinder 9 that serves as the stop. A veneer sheet such as 14 having the thickness L4, for example, of about 4 mm is fed into the apparatus between the upper and the lower dehydrating rollers 13, 1. The veneer sheet 14 is compressed or squeezed across the thickness thereof by the upper and the lower dehydrating rollers 13, 1, as shown in FIG. 1. Referring to FIG. 11, the two lower dehydrating rollers 1 which are shown in fragmentary view on the opposite sides of the drawing and past which part of the veneer sheet 14 having no knot such as 14A moves remain substantially unmoved, so that the spaced distance L7 between the upper and the lower dehydrating rollers 13, 1 remains substantially the same. Therefore, the part of the veneer sheet 14 free of knot is compressed to a thickness that is about 30% of the original thickness L4, with the result that part of the water contained in the veneer sheet 14 is removed. The water squeezed out from the opposite surfaces of the veneer sheet 14 flows toward the infeeding side of the apparatus, or leftward as seen in FIG. 1, from the position where the veneer sheet 14 is compressed. It is noted that the lower dehydrating roller 1 may be moved slightly from the initial setting position against the urging force depending on the condition of veneer sheet such as irregularity in thickness or hardness.

Referring to the lower dehydrating roller 1 at the middle in FIG. 11 past which a part of the veneer sheet 14 having a knot 14A just moves, the lower dehydrating roller 1 is pushed downward, while causing the support members 3, 4 to swing about the pivot shaft 7 in clockwise direction as seen in FIG. 1, against the urging force of the hydraulic cylinder 9 by a force that is due to the presence of the relatively hard knot 14A in the veneer sheet 14. In this case, the lower dehydrating roller 1 is moved to a position where the spaced distance between the upper and the lower dehydrating rollers 13, 1 becomes approximately L4 corresponding to the original thickness of the veneer sheet 14. Because of the above-described setting of the hydraulic pressure of the cylinder 9, the knot 14A resists the urging force and passes through the nip between the upper and the lower dehydrating rollers 13, 1 without being broken. It is noted that those parts of the veneer sheet 14 which are located just on the opposite sides of the knot 14 are not squeezed and, therefore, no dehydration of the veneer occurs. After the knot 14A in the veneer sheet 14 has moved past the nip between the rollers 13, 1, the lower dehydrating roller 1 returns to the squeezing position shown in FIG. 1.

As shown in FIG. 11, there exist regions of clearance 15 between the rim portions 1A of any two adjacent lower dehydrating rollers 1 where the veneer sheet 14 is clear of contact with the lower dehydrating roller 1. Part of the water squeeze and flowing out from the veneer sheet 14 is attached to the lower surface of the veneer sheet 14 that is exposed to the clearance region 15 and moved past the dehydrating rollers 13, 1 with the veneer sheet 14. Such water is absorbed by the veneer sheet 14 which is then expanded to resume its original thickness after moving past the nip between the upper and the lower dehydrating rollers 13, 1. According to the first embodiment, therefore, the veneer sheet 14 moved past the apparatus may have an irregularity in the degree of dehydration. Such veneer sheet, if kiln dried, will suffer from an irregularity in the moisture content, which may cause insufficient or failure in the lamination of veneer.

Figure 12:
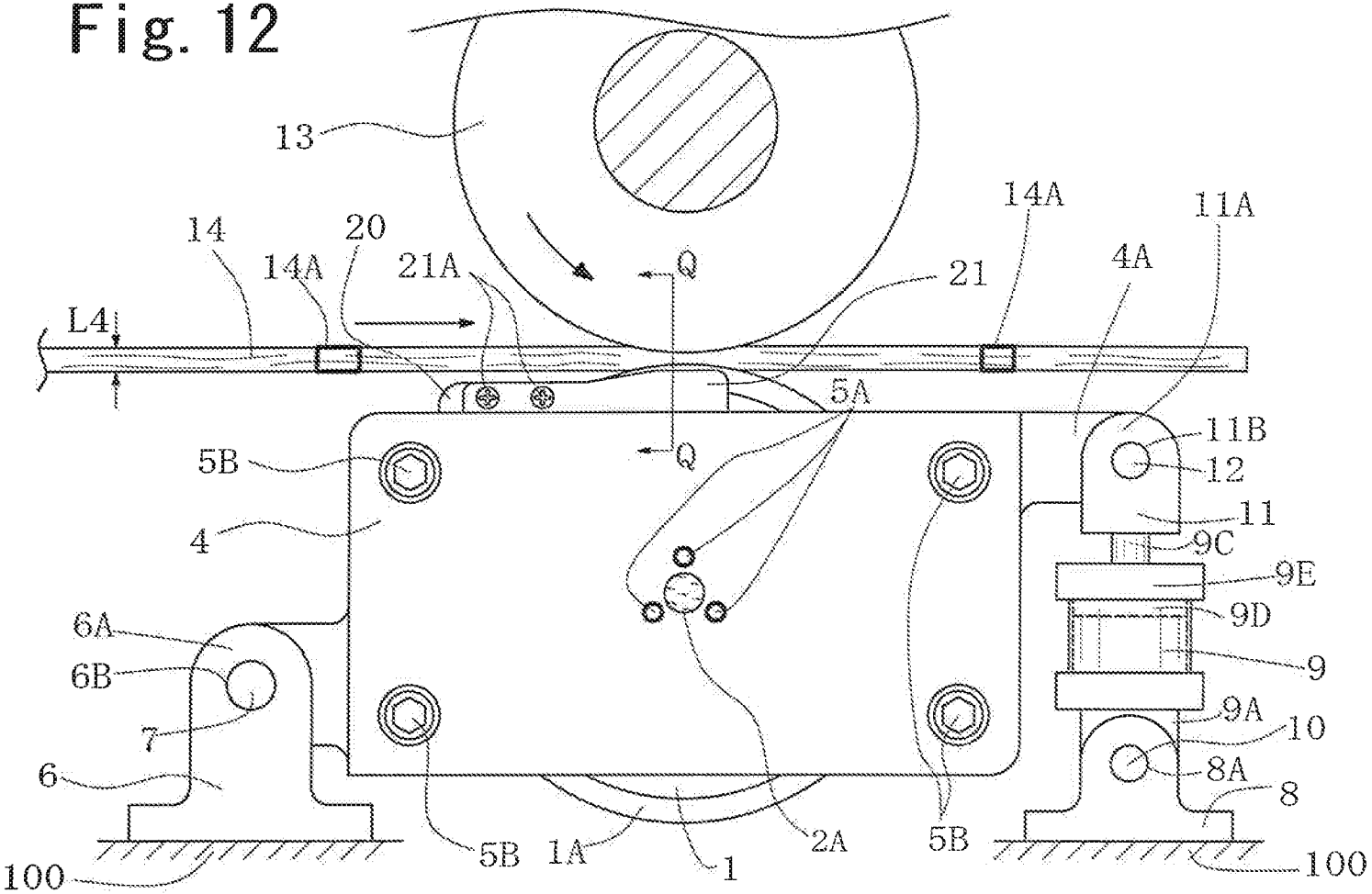
FIG. 12 is a schematic side view of a veneer dehydrating apparatus according to a second embodiment of the present invention.
Figure 13:
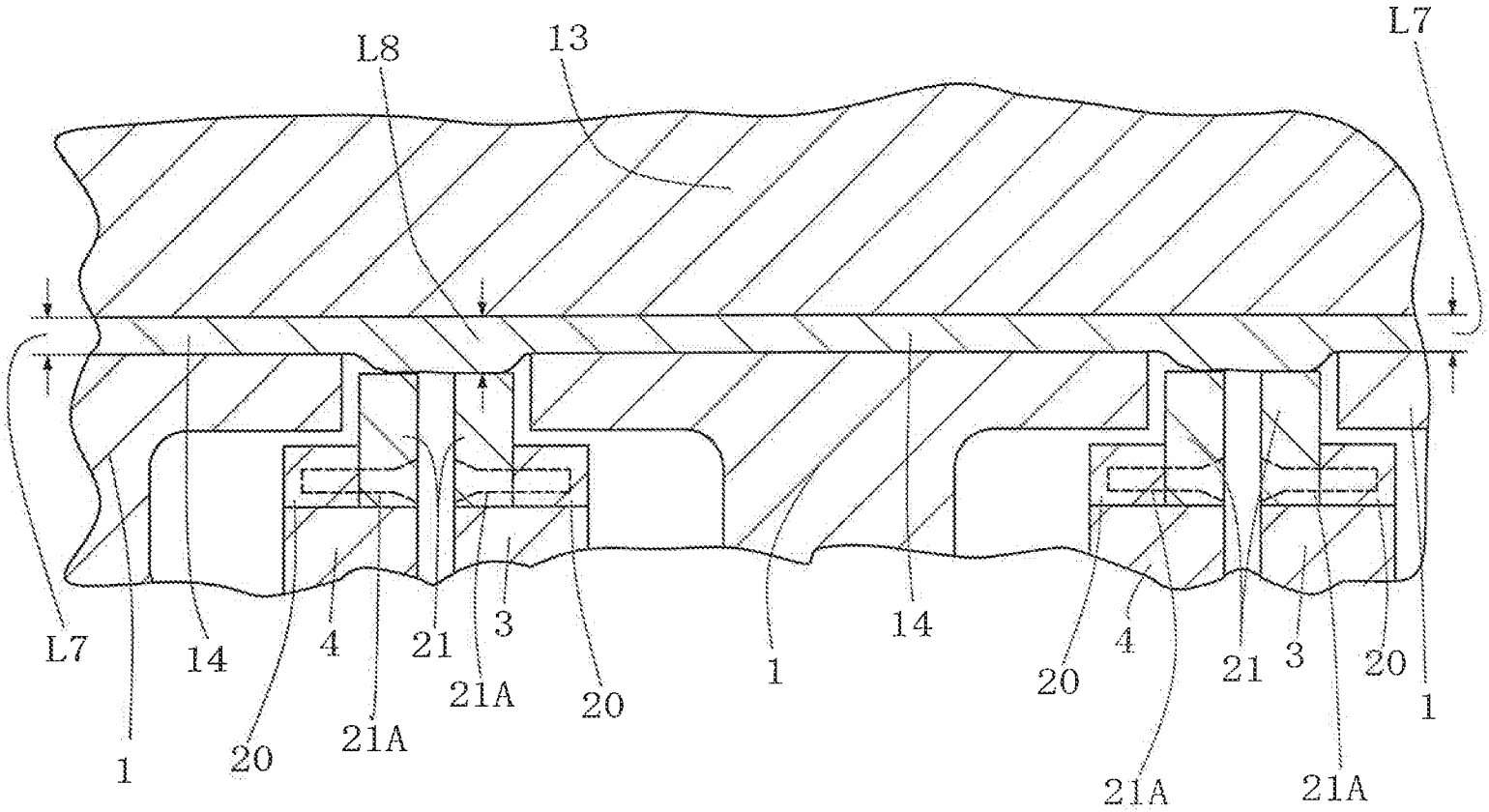
FIG. 13 is a partially-enlarged view of the veneer dehydrating apparatus of FIG. 12 as viewed in the arrow direction Q-Q of FIG. 12.

The second embodiment of the present invention shown in FIGS. 12 and 13 has been made for the purpose of solving the above-identified problem associated with uneven dehydration result. The second embodiment differs from the first embodiment in that a filler member is provided to the first and the second support members 3, 4. Referring to the drawings, numeral 21 designates a filler member which is made of a metal block and fastened by means of a screw 21A to a mounting 20 which is in turn fixed to the top of the first and the second support members 3, 4. The filler member 21 is positioned between the rim portions 1A of any two adjacent lower dehydrating rollers 1 as shown in FIG. 13 and shaped such that its top surface adjacent to the nip between the upper and the lower dehydrating rollers 13, 1 is curved upwardly toward the position where the spaced distance between the rollers 13, 1 is the smallest and also that the highest top surface of the filler member 21 is formed flat extending for about 30 mm in the veneer feeding direction. As shown in FIG. 13, the spaced distance L8 between this flat surface and the upper dehydrating roller 13 is substantially the same as or slightly smaller than the distance corresponding to the thickness L4 of the veneer sheet 14. The rest of the structure of the veneer dehydrating apparatus is substantially the same as that of the first preferred embodiment of FIG. 1 and, therefore, the description thereof will be omitted.

The filler members 21 is placed in contact at the flat top surface thereof with the part of the lower surface of the veneer sheet 14 which is present in the region 15, thus the region 15 being partially filled with the filler members 21. Therefore, the amount of the water attached to the lower surface of the veneer sheet 14 and carried therewith is restricted by the filler member 21, so that the amount of water absorbed by the veneer sheet 14 is reduced. As indicated earlier, the filler member 21 may be formed in such a way that the spaced distance L8 between the flat surface of the filler member 21 and the upper dehydrating roller 13 is slightly smaller than the dimension L4. In this case, the part of the veneer sheet 14 between the rim portions 1A of any two adjacent lower dehydrating rollers 1 may be subjected to some compression, so that some amount of water may be squeezed out from the part of the veneer sheet 14 in the region 15. The filler member 21 which is made of a metal block, not in the form of a roller, may cause harmful friction with the veneer sheet 14 depending on its magnitude. In order to forestall such trouble, care should be taken in setting of the spaced distance between the flat top surface of the filler member 21 and the upper dehydrating roller 13.

Figure 14:
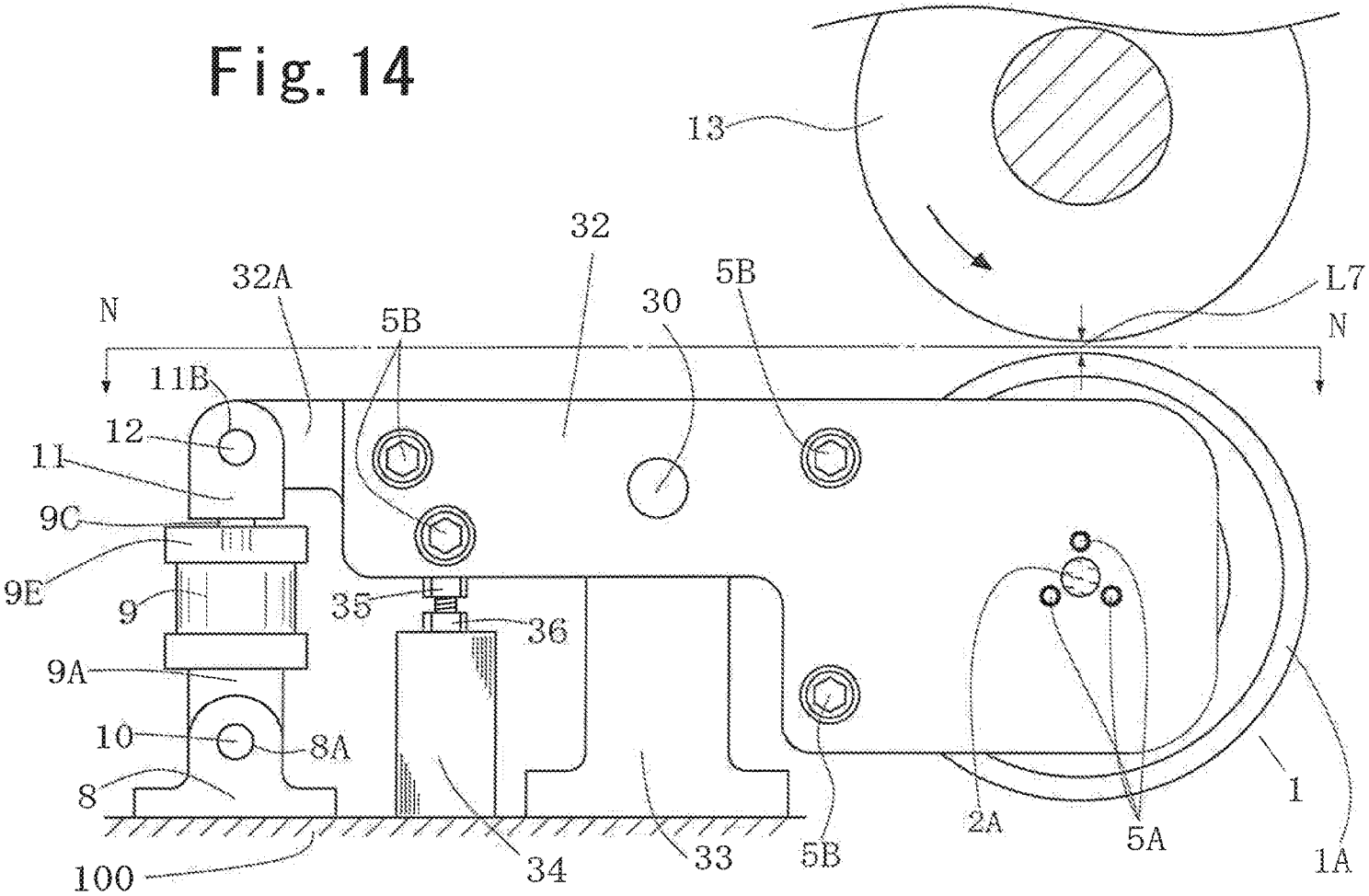
FIG. 14 is a fragmentary schematic side view of a veneer dehydrating apparatus according to a third embodiment of the present invention.
Figure 15:
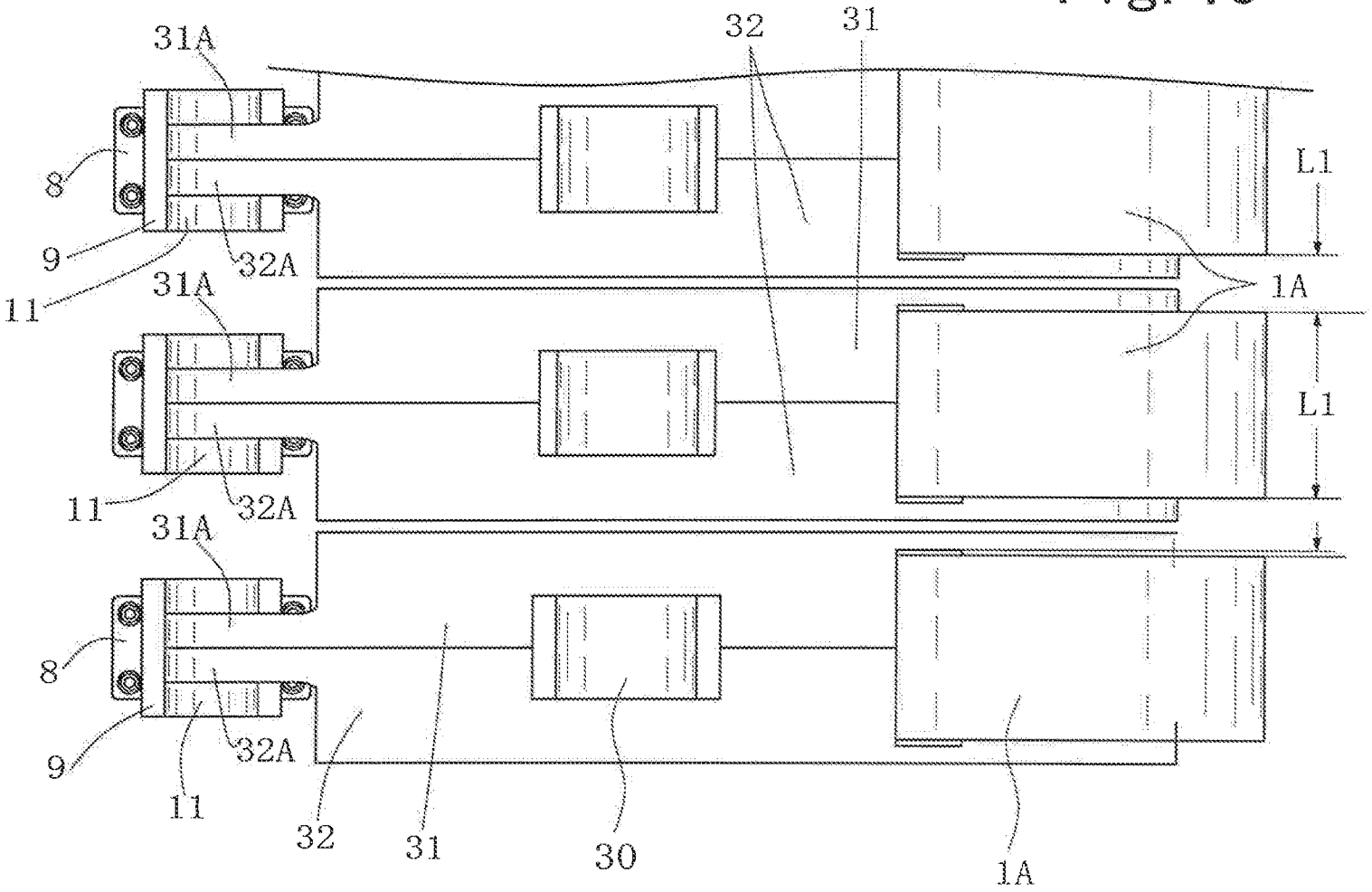
FIG. 15 is a fragmentary plan view of the veneer dehydrating apparatus of FIG. 14 as seen in the arrow direction N-N of FIG. 14.

The following will describe the third embodiment according to the present invention with reference to FIGS. 14 and 15. The third embodiment differs from the first preferred embodiment in that the support block 8, the hydraulic cylinder 9 and the link member 11 which have been described with reference to the first preferred embodiment are disposed on the opposite side of the dehydrating rollers 1, 13 as seen in FIG. 1, or located upstream of the dehydrating roller 1, 13 with respect to the moving direction of the veneer sheet 14. Numerals 31, 32 designate the first and the second support members for the lower dehydrating roller 1 corresponding to their counterpart support members 3, 4 in the first embodiment. The first and the second support members 31, 32 are pivotally mounted on a pivot shaft 30 which is in turn fixedly mounted to a support block 33 fixed to the frame 100 of the veneer dehydrating apparatus. The link member 11 is pivotally mounted on the shaft 12 which is fixedly connected to the mounting lugs 31A, 32A of the support members 31, 32. As is apparent from the drawing, since the support members 31, 32 are different in shape from the counterpart members 3, 4 of the first embodiment, the fastening bolts 5B are located at different positions. It is noted that the parts designated by numerals 34, 35, 36 in FIG. 14 are not used in the apparatus of this third embodiment, but they are used in a modified embodiment which will be described in later part hereof.

The hydraulic cylinder 9 in the embodiment of FIG. 14 differs from the cylinder used in the first embodiment in that the hydraulic pressure of the cylinder 9 acts downward so as to move the piston rod 9C in the retracting direction thereby to urge the lower dehydrating roller 1 upward to the initial setting position where the spaced distance L7 is formed between the first and the second dehydrating rollers 13, 1. This initial setting position of the lower dehydrating roller 1 is determined by the contact of the movable link member 11 with the top end surface 9E of the cylinder 9, which serves as the stop. It is noted that in FIG. 14 the piston rod 9C is shown to be in an extended position in the initial setting position of the lower dehydrating roller 1 for the sake of showing the piston rod 9C of the hydraulic cylinder 9.

In the third embodiment, the lower dehydrating roller 1 is movable away from the first dehydrating roller 13 by causing the support members 31, 41 to swing about the pivot shaft 30 against the urging force due to the presence of any knot such as 14A moving past the nip between the upper and the lower dehydrating rollers 13, 1.

In the above first to third embodiments, the diameter of the upper dehydrating roller 13 may be between 200 mm and 500 mm and the width L1 of the rim portion 1A of the lower dehydrating roller 1 between 30 mm to 80 mm.

The above-described embodiments may be modified in various way without departing from the spirit of the present invention, as exemplified below.

In the above-described embodiments, the initial setting position of the lower dehydrating roller 1 where the spaced distance L7 is formed between the upper and the lower rollers 13, 1 is accomplished by the contact of the piston 9D with the inner surface of the upper end 9E of the cylinder 9 or by the contact of the link member 11 with the top end surface 9E of the cylinder 9.

Referring again to FIG. 14 which has been used for describing the third embodiment, numeral 34 designates a mounting block 34 fixed to the frame 100 of the veneer dehydrating apparatus and having formed therein an internally threaded hole (not shown). An adjusting bolt 35 having a head contactable with the bottom of the first and the second support members 31, 41 is screwed in the threaded hole in the mounting block 34. Numeral 36 designates a lock bolt. In this case, the initial setting position of the lower dehydrating roller 1 may be adjusted by turning the adjusting bolt 35. After the desired position has been obtained by the adjustment, the adjusting bolt 35 is fixed in place by tightening the lock bolt 36. In this case, the adjusting bolt 35 serves as the adjustable stop. The provision of such adjustable stop device makes possible easy adjustment and changing of the spaced distance between the upper and the lower dehydrating rollers 13, 1.

Figure 16:
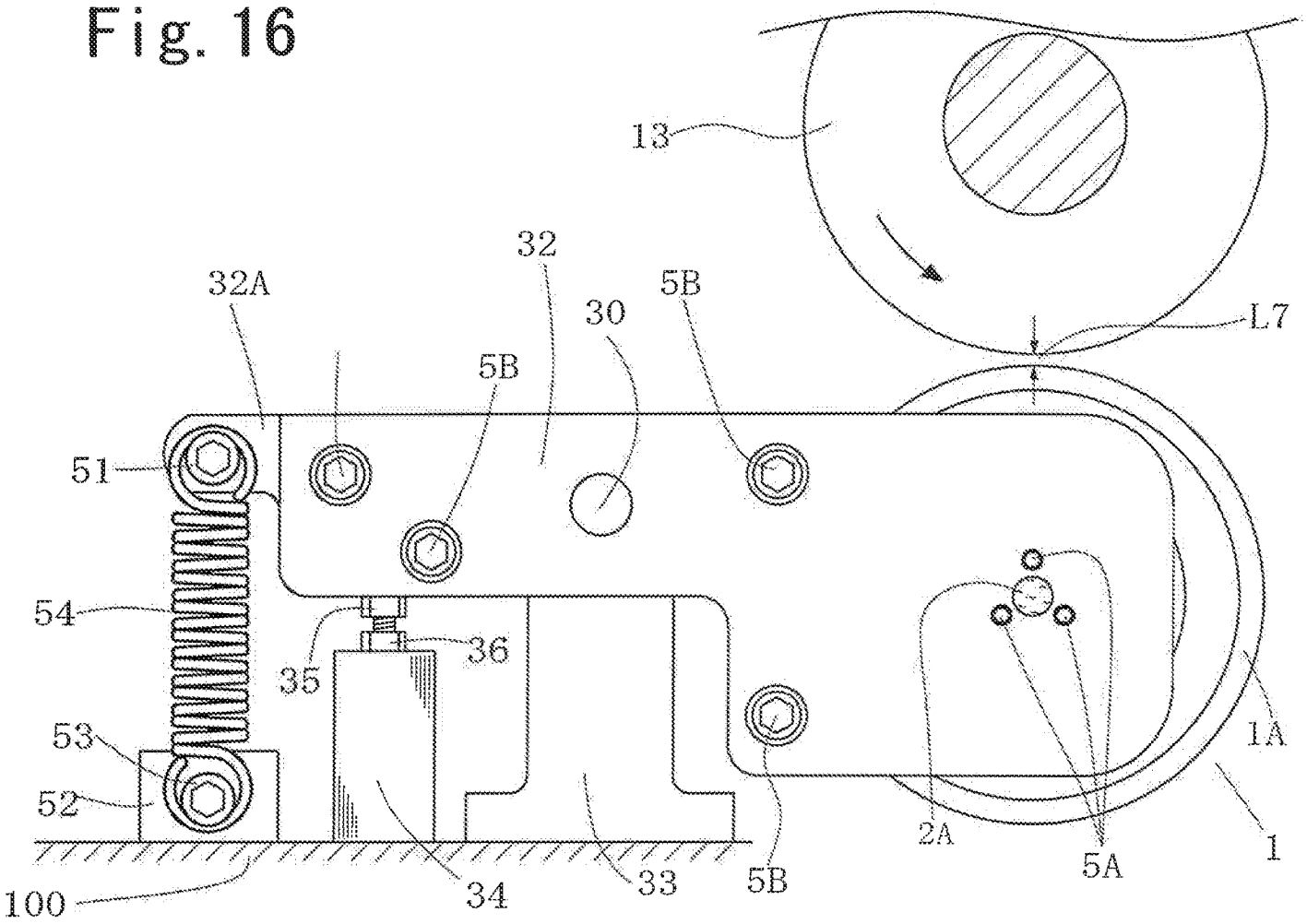
FIG. 16 is a fragmentary side view of a veneer dehydrating apparatus according to a modified embodiment of the present invention.

Referring to FIG. 16, the modification shown in the drawing differs from the embodiment of FIG. 14 in that a tension spring 54 is used instead of the hydraulic cylinder 9. The tension spring 54 is hooked at the upper end thereof on a bolt 51 screwed in the mounting lug 32A of the second support member 32 and at the lower end thereof on a bolt 53 screwed in a support block 52 fixed to the frame 100 of the veneer dehydrating apparatus, so that the bolt 51 and hence the mounting lug 32A of the support member 32 is urged downward, while the lower dehydrating roller 1 is urged upward. For the initial setting position of the lower dehydrating roller 1, the length to which the tension spring 54 is extended may be determined so that the two conditions mentioned earlier with reference to the pressure setting of the hydraulic cylinder 9 in the first embodiment may be fulfilled. As in the case of the first embodiment using the hydraulic cylinder 9, that the lower dehydrating roller 1 is yieldably urged to a position where the lower dehydrating roller 1 is spaced away from the upper dehydrating roller 13 with a force that is largest in the range of force that causes very little breakage to a knot present in the veneer sheet. As in the case of embodiment described with reference to FIG. 14, the initial setting position of the lower dehydrating roller 1 may be adjusted by turning the adjusting bolt 35. In the case of using a tension spring as the urging device, it is to be noted that the urging force of the spring 54 is increased when it is extended by the downward movement of the lower dehydrating roller 1 due to the passage of a veneer sheet between the dehydrating rollers 13, 1, with the result that the urging force of the spring 54 may exceed the largest force in the range of force that causes very little breakage to a knot present in the veneer sheet. Therefore, the extended length of the spring 54 for the initial setting should be slightly smaller, e.g. by half the thickness of the veneer sheet 14, than the first-mentioned length.

Figure 17:
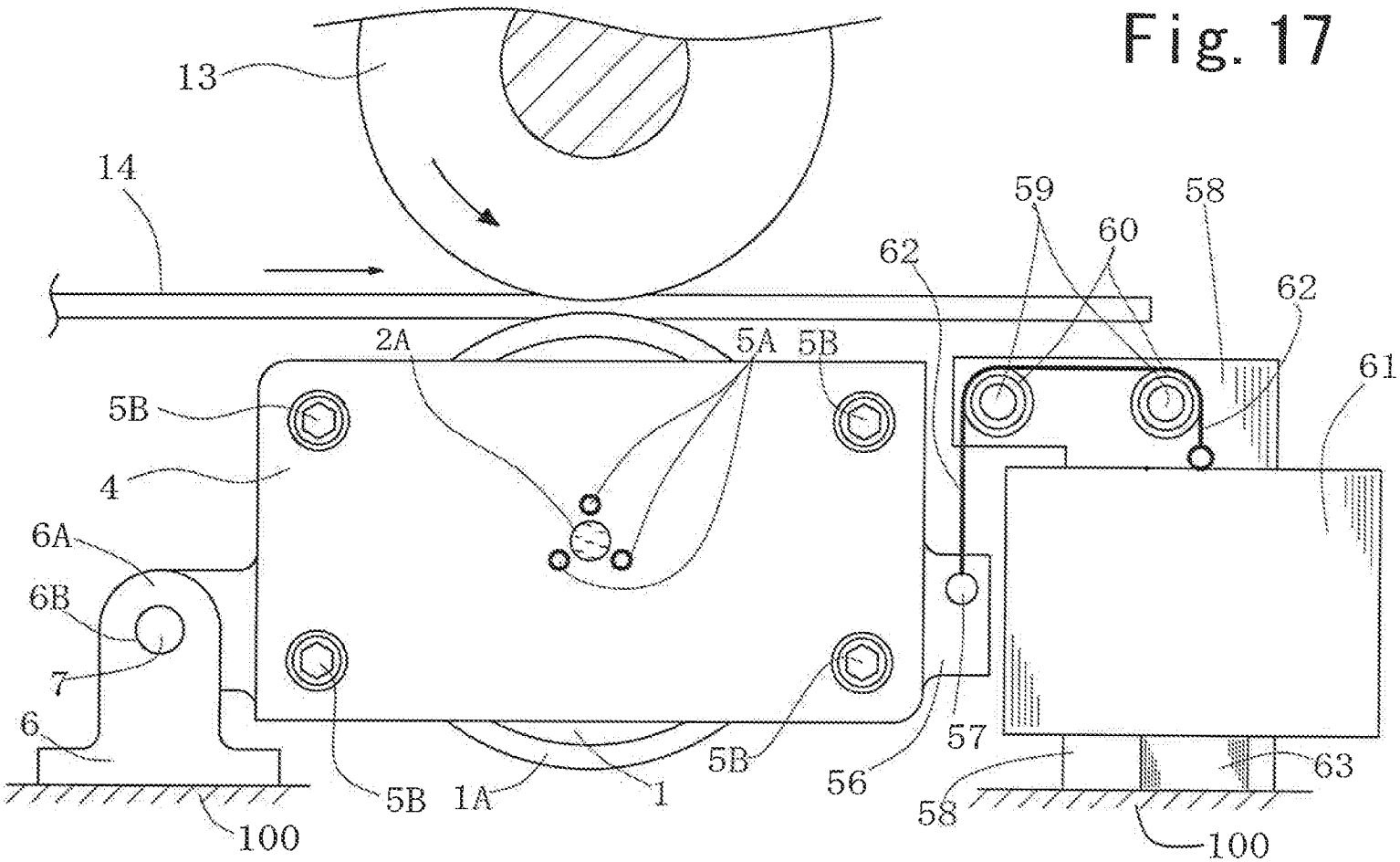
FIG. 17 is a fragmentary side view of a veneer dehydrating apparatus according to another modified embodiment of the present invention.

Referring to FIG. 17 showing still another modification, a counterweight mechanism is used as the urging device in place of the hydraulic cylinder 9 of the first embodiment of FIG. 1. In the drawing, numeral 61 designates a weight member and 58 a support block which is fixed to the frame 100 of the veneer dehydrating apparatus. The support block 58 has in the upper part thereof two guide rollers 59 disposed at the same level in the support block 58 and rotatably supported by bearings 60. A stainless steel wire 62 is connected between the top of the weight member 61 and holes 57 which are formed through lugs 56 of the first and the second support members 3, 4 by way of the two guide rollers 59. The weight of the weight member 61 causes the first and the second support members 3, 4 to tend to swing in counterclockwise direction as seen in the drawing about the pivot shaft 7, thereby yieldably urging the lower dehydrating roller 1 toward the upper dehydrating roller 13. Numeral 63 designates a stop block that determines the lowermost position of the weight member 61 where the spaced distance L7 is formed between the upper and the lower dehydrating rollers 13, 1.

The force that urges the lower dehydrating roller 1 upward depends on the weight of the weight member 61. Specifically, the actual urging force acting on the lower dehydrating roller 1 upward is approximately the difference between the force acting upward due to the weight of the weight member 61 on one hand and the force acting downward due to the weight of components such as the support members 3, 4 and the lower dehydrating roller 1. Therefore, the desired urging force may be determined through adjustments by changing the weight of the weight member 61.

Figure 18:
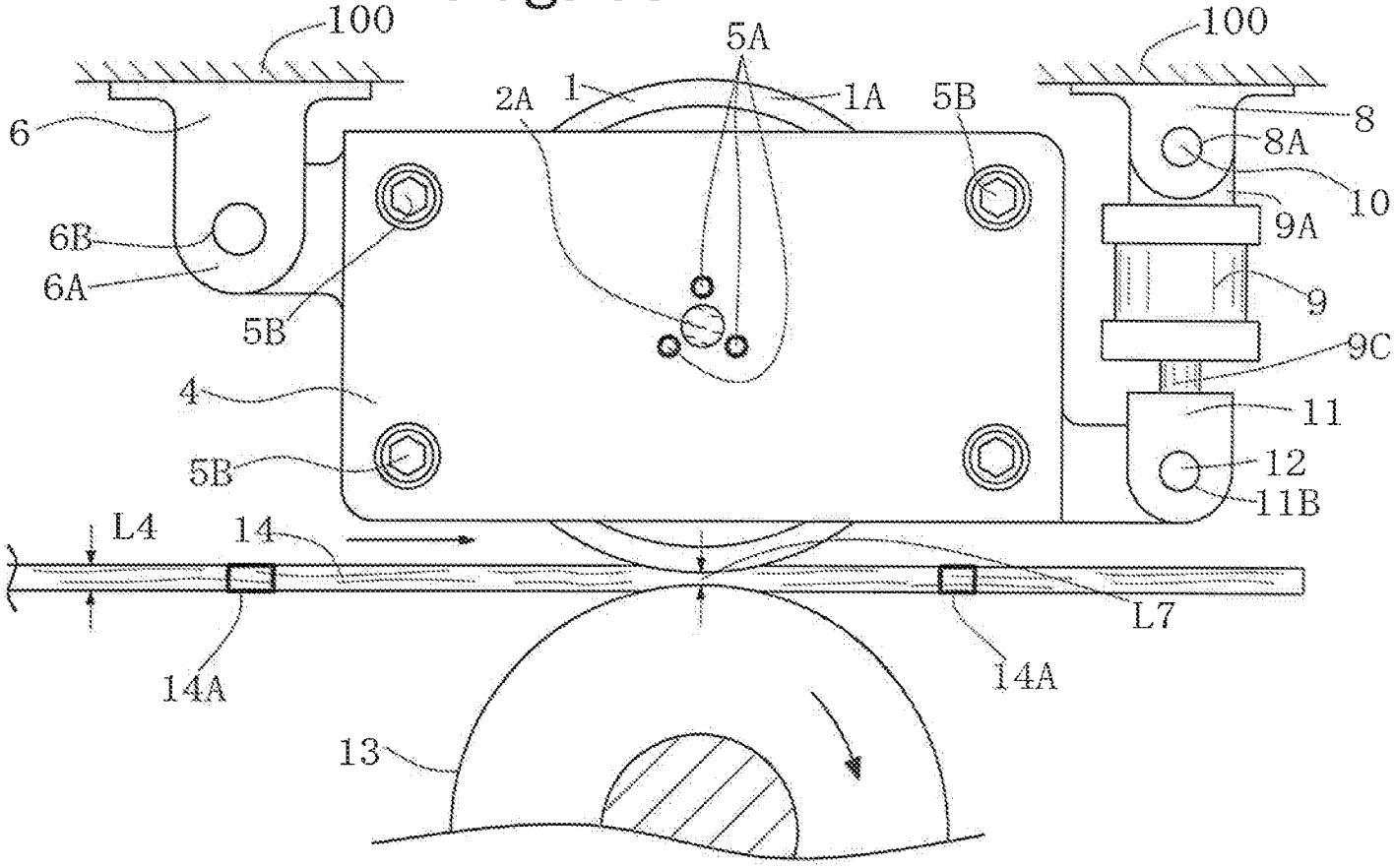
FIG. 18 is a fragmentary side view of a veneer dehydrating apparatus according to still another modified embodiment of the present invention.

According to the present invention, the positions of the individually movable dehydrating rollers 1 supported by the first and the second support members 3, 4 and the single stationary dehydrating roller 13 which are disposed one above the other may be reversed. As shown in FIG. 18, the dehydrating rollers 1 may be disposed above the stationary single dehydrating roller 13. In this case, the actual urging force acting on the upper dehydrating roller 1 is approximately the sum of the force exerted by the hydraulic cylinder 9 and the force due to the weight of components such as the upper dehydrating roller 1 and its support members 3, 4. Therefore, the hydraulic pressure of the cylinder 9 for urging the upper dehydrating roller 1 should be established with such matter taken into account.

In the above-described embodiments, the single stationary roller 13 and the plural dehydrating rollers 13, 1 have been shown and illustrated to have plain cylindrical surface. According to the present invention, the dehydrating rollers 13 and/or 1 may be formed on the periphery thereof with a number of metal projections of any desired shape for increasing the frictional force between the dehydrating roller and the veneer sheet thereby to increase the force to move the veneer sheet between the dehydrating rollers 13, 1. A knot in veneer having a high compression Young's modulus may be broken when subjected to compression or squeezing by the dehydrating roller having such projections. In order to forestall such breakage of a knot, it may be so arranged that at least either one of the single stationary dehydrating roll and the plural movable dehydrating rolls are clad on the periphery thereof with a layer of elastic material such as rubber with a predetermined thickness.

Although the invention has been described in conjunction with some specific embodiments and modification, it is evident to those skilled in the art that present invention may be practiced in various alternatives and variations without departing from the spirit and the scope of the present invention.

What is claimed is:

1. An apparatus for dehydrating a veneer sheet, comprising:

a stationary first dehydrating roller driven to rotate about an axis of rotation thereof;

a plurality of rotatable second dehydrating rollers, configured to directly contact with the veneer sheet, separately mounted on a respective hydraulic cylinder, and having respective axes of rotation extending parallel to the axis of rotation of the stationary first dehydrating roller and individually movable toward and away from the stationary first dehydrating roller;

a stop device for determining a position of the plurality of rotatable second dehydrating rollers relative to the stationary first dehydrating roller where each of the plurality of rotatable second dehydrating rollers is spaced from the stationary first dehydrating roller at a predetermined distance;

said respective hydraulic cylinder urging the respective rotatable second dehydrating rollers independently to said position with a force passing between the stationary first dehydrating roller and said respective rotatable second dehydrating rollers while allowing said respective rotatable second dehydrating rollers to independently move away from the stationary first dehydrating roller independently of the other second dehydrating rollers by a force that is due to a knot in the veneer sheet passing between any of said second dehydrating rollers and the first dehydrating roller; and a support device rotatably supporting each of the plurality of rotatable second dehydrating rollers, said support device being swingable about a pivot, said respective hydraulic cylinder urging the plurality of rotatable second dehydrating rollers by way of the support device, and said stop device limiting swinging motion of the support device.

2. The apparatus according to claim 1, wherein the support device includes at least two combined support members having the plurality of rotatable second dehydrating rollers interposed therebetween.

3. The apparatus according to claim 1, wherein the stop device is adjustable.

4. The apparatus according to claim 1, wherein the plurality of rotatable second dehydrating rollers are disposed with a space formed between any two of the plurality of rotatable second dehydrating rollers located adjacent to each other, the apparatus further comprising a filler member fixedly mounted to the support device at a position that is between any two of the plurality of rotatable second dehydrating rollers located adjacent to each other, the filler member spaced away from the stationary first dehydrating roller and configured to fill partially said space between any two of the plurality of rotatable second dehydrating rollers located adjacent to each other.

5. The apparatus according to claim 1, further including an adjustable stop device.

6. The apparatus according to claim 2, further including an adjustable stop device.

7. The apparatus according to claim 1, wherein the plurality of rotatable second dehydrating rollers are disposed with a space formed between any two of the plurality of rotatable second dehydrating rollers located adjacent to each other, the apparatus further comprising a filler member fixedly mounted to the support device at a position that is between any two of the plurality of rotatable second dehydrating rollers located adjacent to each other, the filler member spaced away from the stationary first dehydrating roller and configured to fill partially said space between any two of the plurality of rotatable second dehydrating rollers located adjacent to each other.

8. The apparatus according to claim 2, wherein the plurality of rotatable second dehydrating rollers are disposed with a space formed between any two of the plurality of rotatable second dehydrating rollers located adjacent to each other, the apparatus further comprising a filler member fixedly mounted to the support device at a position that is between any two of the plurality of rotatable second dehydrating rollers located adjacent to each other, the filler member spaced away from the stationary first dehydrating roller and configured to fill partially said space between any two of the plurality of rotatable second dehydrating rollers located adjacent to each other.

9. The apparatus according to claim 3, wherein the plurality of rotatable second dehydrating rollers are disposed with a space formed between any two of the plurality of rotatable second dehydrating rollers located adjacent to each other, the apparatus further comprising a filler member fixedly mounted to the support device at a position that is between any two of the plurality of rotatable second dehydrating rollers located adjacent to each other, the filler member spaced away from the stationary first dehydrating roller and configured to fill partially said space between any two of the plurality of rotatable second dehydrating rollers located adjacent to each other.

10. Method for dehydrating a veneer sheet, comprising:

preparing a veneer sheet with a predetermined thickness and having therein a knot;

providing an apparatus for dehydrating the veneer sheet, the apparatus comprising:

a stationary first dehydrating roller driven to rotate about an axis of rotation thereof;

a plurality of rotatable second dehydrating rollers, configured to directly contact with the veneer sheet, separately mounted on a respective hydraulic cylinder, and having respective axes of rotation extending parallel to the axis of rotation of the stationary first dehydrating roller and individually movable toward and away from the stationary first dehydrating roller;

a stop device for determining a position of the plurality of rotatable second dehydrating rollers relative to the stationary first dehydrating roller where each of the plurality of rotatable second dehydrating rollers is spaced from the stationary first dehydrating roller at a predetermined distance;

said respective hydraulic cylinder urging the respective rotatable second dehydrating rollers independently to said position with a force passing between the stationary first dehydrating roller and said respective rotatable second dehydrating rollers while allowing said respective rotatable second dehydrating rollers to independently move away from the stationary first dehydrating roller independently of the other second dehydrating rollers by a force that is due to the knot in the veneer sheet passing between any of said second dehydrating rollers and the first dehydrating roller; and a support device rotatably supporting each of the plurality of rotatable second dehydrating rollers, said support device being swingable about a pivot, said respective hydraulic cylinder urging the plurality of rotatable second dehydrating rollers by way of the support device, and said stop device limiting swinging motion of the support device;

yieldably urging each of the plurality of rotatable second dehydrating rollers toward the stationary first dehydrating roller to a position where the rotatable second dehydrating roller is spaced from the stationary first dehydrating roller at a predetermined distance that is smaller than thickness of the veneer sheet, said urging being performed with a force that is largest in a range of force that causes very little breakage to the knot present in the veneer sheet; and passing the veneer sheet between the stationary first dehydrating roller and the rotatable second dehydrating rollers.

11. An apparatus for dehydrating a veneer sheet, comprising:

a stationary first dehydrating roller driven to rotate about an axis of rotation thereof, a plurality of rotatable second dehydrating rollers having respective axes of rotation extending parallel to the axis of rotation of the stationary first dehydrating roller and individually movable toward and away from the stationary first dehydrating roller, said plurality of rotatable second dehydrating rollers being separately mounted on respective urging devices including any one of hydraulic cylinder/piston mechanism, tension springs and weights;

a stop device for determining a position of the plurality of rotatable second dehydrating rollers relative to the stationary first dehydrating roller where each of the plurality of rotatable second dehydrating rollers is spaced from the stationary first dehydrating roller at a predetermined distance;

said urging device urging the respective rotatable second dehydrating rollers independently to said position with a force passing between the stationary first dehydrating roller and said respective rotatable second dehydrating rollers while allowing said respective rotatable second dehydrating rollers to independently move away from the stationary first dehydrating roller independently of the other second dehydrating rollers by a force that is due to a knot in the veneer sheet passing between any of said second dehydrating rollers and the first dehydrating roller; and a roller support device including a pair of support members swingably supported by a first support block and a second support block, said roller support device being pivotally connected to said urging device and rotatably supporting each of the plurality of rotatable second dehydrating rollers, said urging device urging the second dehydrating roller by way of said roller support device, said stop device limiting swinging motion of said roller support device thereby to determine said position of each of the plurality of rotatable second dehydrating rollers.

12. The apparatus for dehydrating a veneer sheet according to claim 11, wherein said hydraulic cylinder/piston mechanism is provided on said second support block, each of said plurality of rotatable second dehydrating rollers being supported by said roller support device including said pair of support members, said roller support device being rotatably mounted on said first support block.

13. The apparatus for dehydrating a veneer sheet according to claim 11, wherein said tension springs is hooked between said roller support device and said second support blocks.

14. The apparatus for dehydrating a veneer sheet according to claim 11, wherein said weights provided said second support block, said support members being swingably supported between said first and second supporting blocks.

* * * * *